US008875948B2

(12) United States Patent
Naughton

(10) Patent No.: US 8,875,948 B2
(45) Date of Patent: Nov. 4, 2014

(54) POWERED DISPENSING TOOL

(71) Applicant: Milwaukee Electric Tool Corporation, Brookfield, WI (US)

(72) Inventor: Michael Naughton, Oconomowoc, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 13/962,016

(22) Filed: Aug. 8, 2013

(65) Prior Publication Data

US 2013/0320040 A1 Dec. 5, 2013

Related U.S. Application Data

(63) Continuation of application No. 13/286,259, filed on Nov. 1, 2011, now Pat. No. 8,528,785.

(60) Provisional application No. 61/413,734, filed on Nov. 15, 2010.

(51) Int. Cl.
*B05C 17/01* (2006.01)
*B05C 17/005* (2006.01)

(52) U.S. Cl.
CPC ..... *B05C 17/0103* (2013.01); *B05C 17/00553* (2013.01); *B05C 17/00576* (2013.01)
USPC ..... 222/137; 222/333; 222/386

(58) Field of Classification Search
USPC ..... 222/135, 137, 386, 333
See application file for complete search history.

(56) References Cited

U.S. PATENT DOCUMENTS

| | | | |
|---|---|---|---|
| 966,861 | A | 8/1910 | Rubly |
| 1,269,438 | A | 6/1918 | Hieatzman |
| 3,208,638 | A | 9/1965 | Frenzel et al. |

(Continued)

FOREIGN PATENT DOCUMENTS

| | | |
|---|---|---|
| CA | 2570384 | 12/2005 |
| DE | 3811954 | 10/1989 |

(Continued)

OTHER PUBLICATIONS

Cox, Product Catalog, 2004 (16 pages).

(Continued)

*Primary Examiner* — Paul R Durand
*Assistant Examiner* — Donnell Long
(74) *Attorney, Agent, or Firm* — Michael Best & Friedrich LLP

(57) ABSTRACT

A powered dispensing tool includes a housing, a motor, a rack operably coupled to the motor for powered translation along a longitudinal axis in at least one of a forward direction and a reverse direction, a transmission housing at least partially positioned within the housing through which the rack is extendable, first and second plungers, at least one of which is coupled to one end of the rack, and a first cartridge housing within which first and second material cartridges may be supported in a side-by-side relationship. The first and second plungers are associated with the first and second material cartridges, respectively. The tool also includes a second cartridge housing within which only a single material cartridge may be supported. The first and second cartridge housings are interchangeably coupled to the transmission housing to adapt the tool for use with dual material cartridges or single material cartridges.

20 Claims, 18 Drawing Sheets

(56) References Cited

U.S. PATENT DOCUMENTS

| | | | | |
|---|---|---|---|---|
| 3,300,100 | A | 1/1967 | Sundholm | |
| 3,323,682 | A * | 6/1967 | Creighton, Jr. et al. | 222/94 |
| 3,341,084 | A | 9/1967 | Sundholm | |
| 3,341,085 | A | 9/1967 | Sundholm | |
| 3,640,431 | A | 2/1972 | Plumer | |
| 3,730,394 | A | 5/1973 | Woodson | |
| 3,768,472 | A | 10/1973 | Hodosh et al. | |
| 3,782,598 | A | 1/1974 | Basa | |
| 3,813,012 | A | 5/1974 | Laird | |
| 3,870,200 | A | 3/1975 | Spatz | |
| 3,997,085 | A | 12/1976 | Lindquist | |
| 4,113,151 | A | 9/1978 | Brown et al. | |
| 4,135,644 | A | 1/1979 | Pacetti | |
| 4,260,076 | A | 4/1981 | Bergman | |
| 4,277,194 | A | 7/1981 | Smith | |
| 4,330,070 | A | 5/1982 | Doubleday | |
| 4,339,058 | A | 7/1982 | Wendt | |
| 4,556,156 | A | 12/1985 | Frutin | |
| 4,570,832 | A | 2/1986 | Kroger | |
| 4,583,934 | A | 4/1986 | Hata et al. | |
| 4,595,124 | A | 6/1986 | Duval et al. | |
| 4,615,469 | A | 10/1986 | Kishi et al. | |
| 4,715,518 | A | 12/1987 | Moore | |
| 4,840,293 | A | 6/1989 | Segatz | |
| 4,854,485 | A | 8/1989 | Collins | |
| 4,871,088 | A | 10/1989 | Cox | |
| 4,872,596 | A | 10/1989 | Corsette | |
| 4,877,156 | A | 10/1989 | Clanet et al. | |
| 4,890,773 | A | 1/1990 | Corsette | |
| 4,907,727 | A | 3/1990 | Ernst et al. | |
| 5,027,984 | A | 7/1991 | Gakhar et al. | |
| 5,088,630 | A | 2/1992 | Arch et al. | |
| 5,139,171 | A * | 8/1992 | Mader | 222/137 |
| 5,139,178 | A | 8/1992 | Arch et al. | |
| 5,161,715 | A | 11/1992 | Giannuzzi | |
| 5,176,291 | A | 1/1993 | Fillmore et al. | |
| 5,240,152 | A | 8/1993 | Scholz | |
| 5,273,190 | A | 12/1993 | Lund | |
| 5,295,614 | A * | 3/1994 | Chang | 222/137 |
| 5,323,931 | A | 6/1994 | Robards, Jr. et al. | |
| 5,332,122 | A * | 7/1994 | Herold et al. | 222/105 |
| 5,353,962 | A | 10/1994 | Scholz et al. | |
| 5,370,271 | A | 12/1994 | Segatz | |
| 5,390,831 | A * | 2/1995 | Schneider | 222/391 |
| 5,405,054 | A | 4/1995 | Thomas | |
| 5,413,255 | A | 5/1995 | Dent | |
| 5,419,466 | A | 5/1995 | Scheindel | |
| 5,441,175 | A * | 8/1995 | Jacobsen et al. | 222/137 |
| 5,492,249 | A | 2/1996 | Beach | |
| 5,556,009 | A | 9/1996 | Motzko | |
| 5,593,066 | A | 1/1997 | Konuma et al. | |
| 5,699,935 | A | 12/1997 | Stahley | |
| 5,775,533 | A | 7/1998 | Schroeder | |
| 5,775,539 | A | 7/1998 | Bates et al. | |
| 5,788,123 | A | 8/1998 | Hackmann et al. | |
| 5,826,751 | A | 10/1998 | Stahley et al. | |
| 5,842,604 | A | 12/1998 | Stahley et al. | |
| 5,860,568 | A | 1/1999 | Mallalieu et al. | |
| 5,873,499 | A | 2/1999 | Leschinsky et al. | |
| 5,893,488 | A | 4/1999 | Hoag et al. | |
| 5,897,028 | A | 4/1999 | Sauer | |
| 5,909,830 | A | 6/1999 | Bates et al. | |
| 6,039,215 | A | 3/2000 | Bell | |
| 6,039,216 | A | 3/2000 | Cummings | |
| 6,082,597 | A | 7/2000 | Beckett et al. | |
| 6,152,334 | A | 11/2000 | Liardon et al. | |
| 6,220,485 | B1 | 4/2001 | Chang | |
| 6,241,130 | B1 | 6/2001 | Heiberger | |
| 6,299,022 | B1 | 10/2001 | Bublewitz et al. | |
| 6,321,951 | B1 | 11/2001 | Frutin | |
| 6,386,400 | B1 | 5/2002 | Scheindel | |
| 6,415,955 | B1 | 7/2002 | Ostreicher | |
| 6,454,129 | B1 | 9/2002 | Green | |
| 6,474,510 | B2 | 11/2002 | Frutin | |
| 6,478,190 | B2 | 11/2002 | Kuge et al. | |
| 6,488,180 | B1 * | 12/2002 | Bayat | 222/137 |
| 6,494,345 | B2 | 12/2002 | Schrader | |
| 6,508,385 | B1 | 1/2003 | Liardon | |
| 6,578,738 | B1 | 6/2003 | Keller | |
| 6,619,508 | B2 | 9/2003 | Balcome et al. | |
| 6,634,524 | B1 | 10/2003 | Helmenstein | |
| 6,701,828 | B1 | 3/2004 | Burns et al. | |
| 6,742,722 | B2 | 6/2004 | Hosoda et al. | |
| 6,745,921 | B2 | 6/2004 | Beckett | |
| 6,752,293 | B2 | 6/2004 | So | |
| 6,789,707 | B2 | 9/2004 | Wright | |
| 6,889,872 | B2 * | 5/2005 | Herman et al. | 222/82 |
| 7,163,130 | B2 | 1/2007 | Lafond | |
| 7,192,267 | B2 | 3/2007 | Glucksman et al. | |
| 7,445,135 | B2 | 11/2008 | Miyata et al. | |
| 7,637,392 | B2 * | 12/2009 | Hsu et al. | 222/137 |
| 7,690,530 | B2 | 4/2010 | Schneider et al. | |
| 7,913,881 | B2 | 3/2011 | Herman | |
| 8,011,538 | B2 | 9/2011 | Herman et al. | |
| 8,020,727 | B2 | 9/2011 | Herman et al. | |
| 8,528,785 | B2 | 9/2013 | Naughton | |
| 2001/0042762 | A1 | 11/2001 | Reichert | |
| 2004/0182882 | A1 | 9/2004 | Langer | |
| 2005/0051571 | A1 | 3/2005 | Carruth et al. | |
| 2007/0235475 | A1 | 10/2007 | Schneider et al. | |
| 2008/0197154 | A1 * | 8/2008 | Herman et al. | 222/326 |
| 2009/0039113 | A1 * | 2/2009 | Hsu et al. | 222/333 |
| 2009/0065527 | A1 | 3/2009 | Buck | |
| 2009/0110786 | A1 | 4/2009 | Wells | |
| 2009/0179045 | A1 | 7/2009 | Cadden | |
| 2009/0272761 | A1 | 11/2009 | Cadden | |
| 2009/0272767 | A1 | 11/2009 | Herman et al. | |
| 2009/0277970 | A1 | 11/2009 | Lind et al. | |
| 2009/0302055 | A1 | 12/2009 | Cadden et al. | |
| 2011/0278327 | A1 | 11/2011 | Herman et al. | |

FOREIGN PATENT DOCUMENTS

| | | |
|---|---|---|
| DE | 102005007055 | 8/2006 |
| EP | 0836534 | 9/2002 |
| WO | 0171293 | 9/2001 |
| WO | 2006015596 | 2/2006 |

OTHER PUBLICATIONS

Cox, Catalogs, Apr. 4, 2005, (date according to waybackmachine.com), {Retrieved May 24, 2011} Retrieved from the Internet <URL: http://www.cox-applicators.com/catalogs.asp>.

Milwaukee Electric Tool Corporation, 14.4V Cordless Caulk & Adhesive Gun Kits, Online Product Sheet, Jun. 25, 2006, (date according to waybackmachine.com), {Retrieved on May 24, 2011} Retrieved from the Internet <URL: http://www.mytoolstore.com/milwauke/6562>.

Milwaukee Electric Tool Corporation, Tool Catalog: Heavy-Duty Caulk & Adhesive Guns, 2003 (3 pages).

Milwaukee Electric Tool Corporation, Cordless 2.4 Volt Screwdriver and Cordless 2.4 Volt Caulking Gun, 1997 (2 pages).

Milwaukee Electric Tool Corporation, 14.4V Cordless Caulk Gun Service Parts List, Oct. 2006 (2 pages).

Milwaukee Electric Tool Corporation, 14.4V Cordless Caulk Gun Operator's Manual, Oct. 2006 (21 pages).

International Search Report and Written Opinion for Application No. PCT/US2011/058585 dated May 5, 2012 (8 pages).

* cited by examiner

POWERED DISPENSING TOOL

CROSS-REFERENCE TO RELATED APPLICATIONS

This application is a continuation of co-pending U.S. patent application Ser. No. 13/286,259 filed Nov. 1, 2011, which claims priority to U.S. Provisional Patent Application No. 61/413,734 filed Nov. 15, 2010, the entire contents of both of which are incorporated herein by reference.

FIELD OF THE INVENTION

The present invention relates to power tools, and more particularly to powered dispensing tools

BACKGROUND OF THE INVENTION

Dispensing tools, such as those used for dispensing caulk, adhesives, or like materials, are typically manually operated by squeezing or grasping a handle of the dispensing tool. The handle is typically connected to a rack via an advancing mechanism (e.g., a ratchet and pawl-type mechanism) to incrementally advance the rack and cause the caulk, adhesive, or like material to be discharged from a cartridge. Such manually operated dispensing tools can be difficult to control and strenuous, thereby fatiguing the user and possibly shortening the duration of time the manually operated dispensing tool may be used before the user requires rest.

SUMMARY OF THE INVENTION

The invention provides, in one aspect, a powered dispensing tool including a housing, a motor at least partially positioned within the housing, a rack operably coupled to the motor for powered translation along a longitudinal axis in at least one of a forward direction and a reverse direction, a transmission housing at least partially positioned within the housing through which the rack is extendable, first and second plungers, at least one of which is coupled to one end of the rack, and a first cartridge housing within which first and second material cartridges may be supported in a side-by-side relationship. The first and second plungers are associated with the first and second material cartridges, respectively. The tool also includes a second cartridge housing within which only a single material cartridge may be supported. The first and second cartridge housings are interchangeably coupled to the transmission housing to adapt the tool for use with dual material cartridges or single material cartridges.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
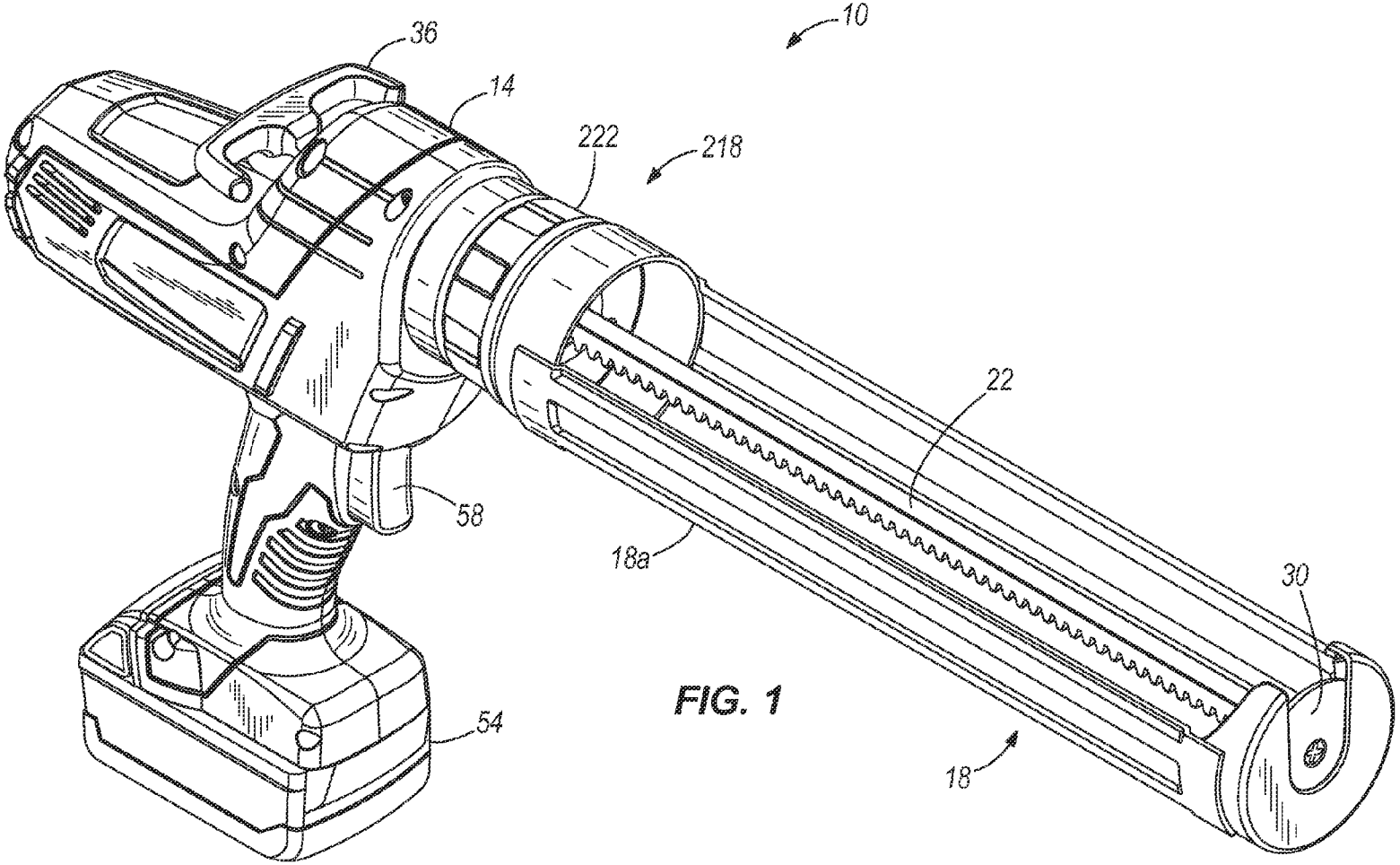
FIG. 1 is a front perspective view of a powered dispensing tool according to an embodiment of the invention.
Figure 2:
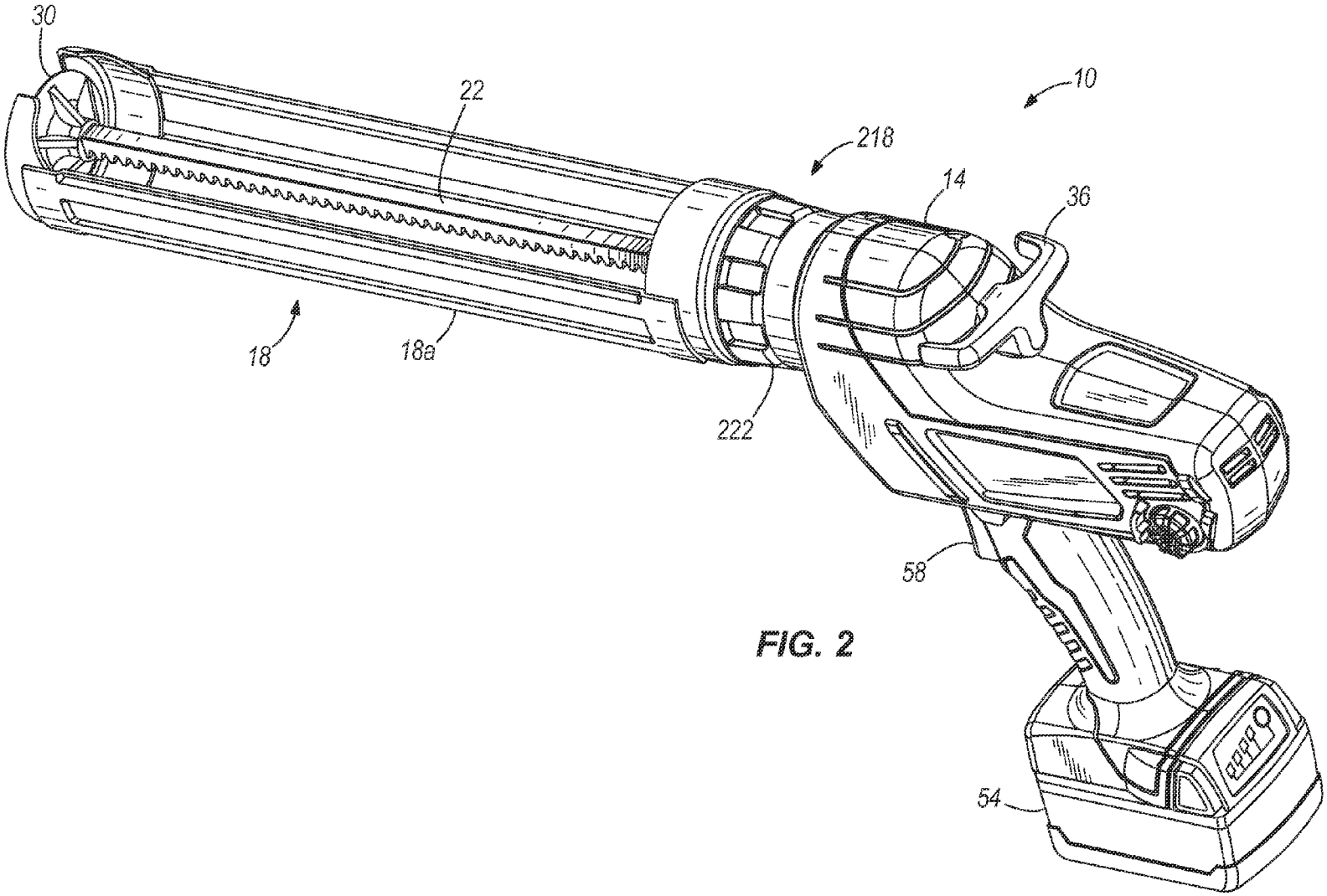
FIG. 2 is a rear perspective view of the powered dispensing tool of FIG. 1.

A powered dispensing tool 10 according to an embodiment of the invention is shown in FIGS. 1 and 2. The tool 10 includes a main housing 14 and a cartridge housing 18 attached to the main housing 14 for supporting a tubular cartridge of caulk, adhesive, or other material to be dispensed. The tool 10 also includes a rack 22 having a first end 26 coupled to a plunger 30 and a second end 34 accessible from the rear of the main housing 14. A handle 36 is coupled to the second end 34 of the rack 22 to facilitate grasping the rack 22 to manually advance or retract the rack 22 relative to the main housing 14. As will be described in greater detail below, the plunger 30 is movable within the cartridge housing 18 in response to the rack 22 being driven or otherwise moved in a forward or reverse direction.

Figure 3:
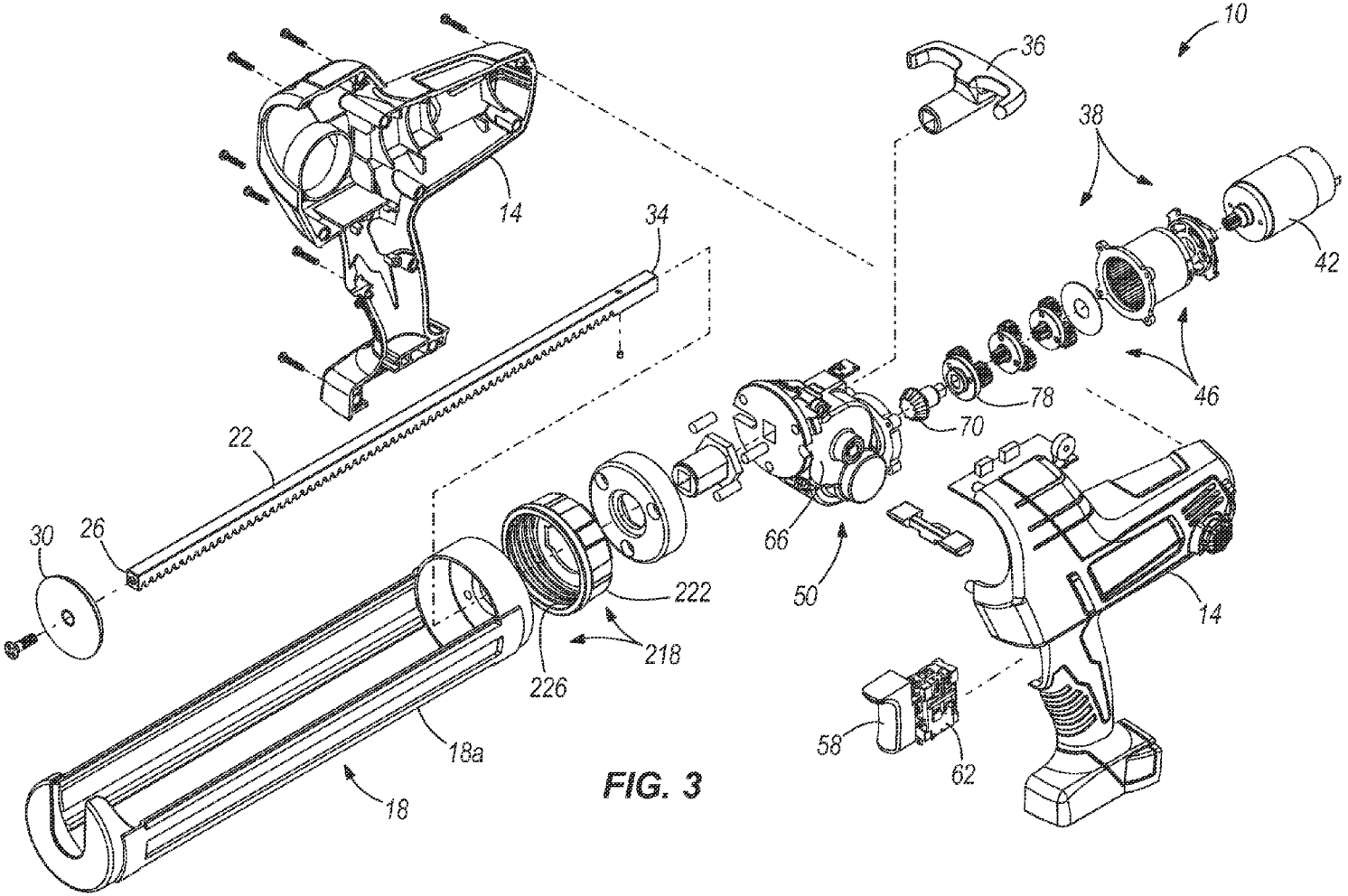
FIG. 3 is an exploded, front perspective view of the powered dispensing tool of FIG. 1.

With reference to FIG. 3, the tool 10 includes a power train assembly 38 positioned within the main housing 14. The power train assembly 38 includes an electric motor 42, a three-stage planetary transmission 46, and a transmission 50 for converting the rotational output of the planetary transmission 46 to a translational output of the rack 22. In the illustrated construction of the tool 10, the motor 42 is configured as a DC motor that receives power from an on-board power source (e.g., a battery 54). The battery 54 may include any of a number of different nominal voltages (e.g., 12V, 18V, etc.), and may be configured having any of a number of different chemistries (e.g., lithium-ion, nickel-cadmium, etc.). Alternatively, the motor 42 may be powered by a remote power source (e.g., a household electrical outlet) through a power cord. The motor 42 is selectively activated by depressing a trigger 58 which, in turn, actuates a switch 62. The switch 62 may be electrically connected to the motor 42 via a top-level or master controller or one or more circuits as described below and shown in FIG. 12.

Figure 4:
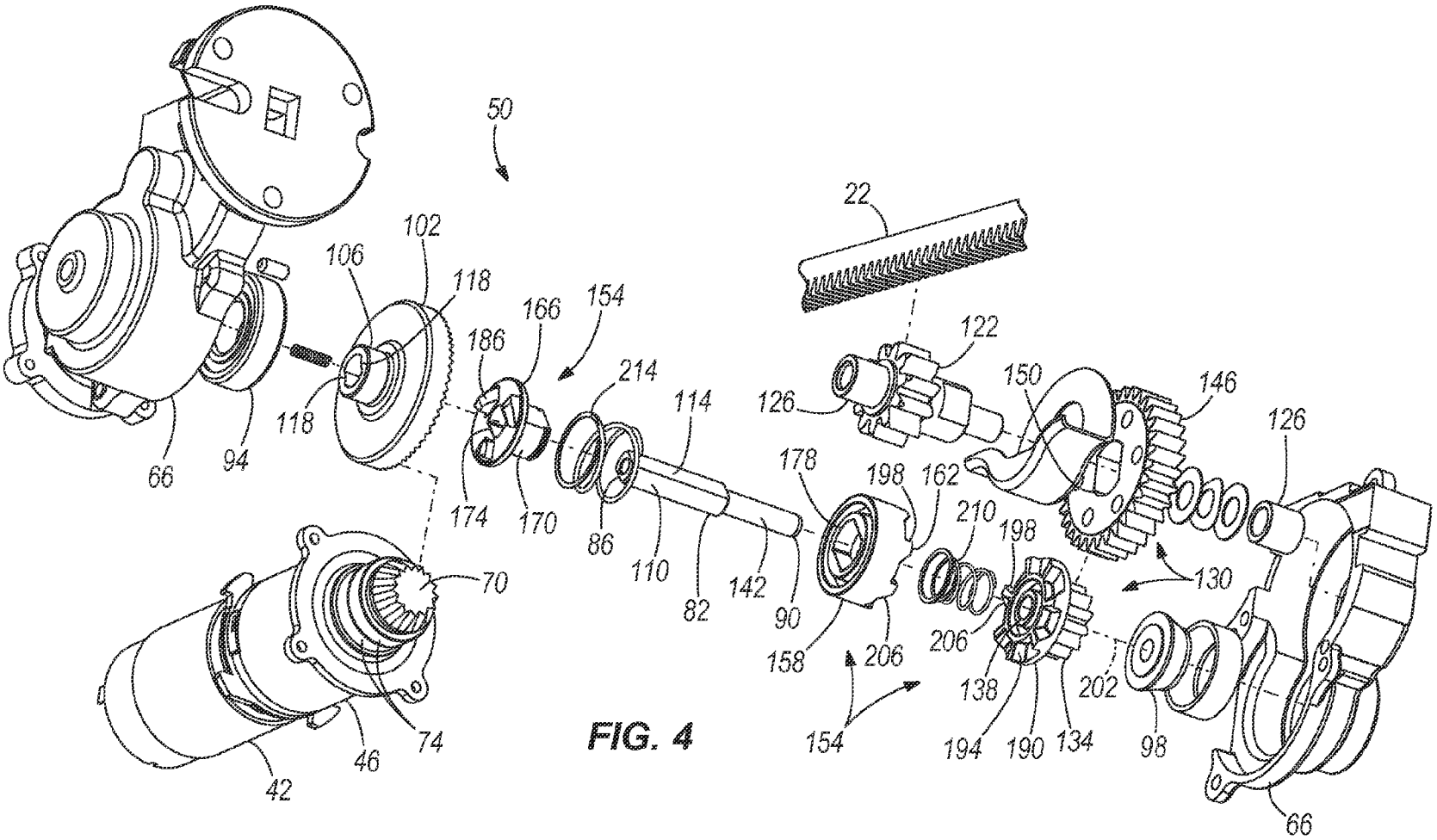
FIG. 4 is an exploded, front perspective view of a transmission in the powered dispensing tool of FIG. 1.
Figure 5:
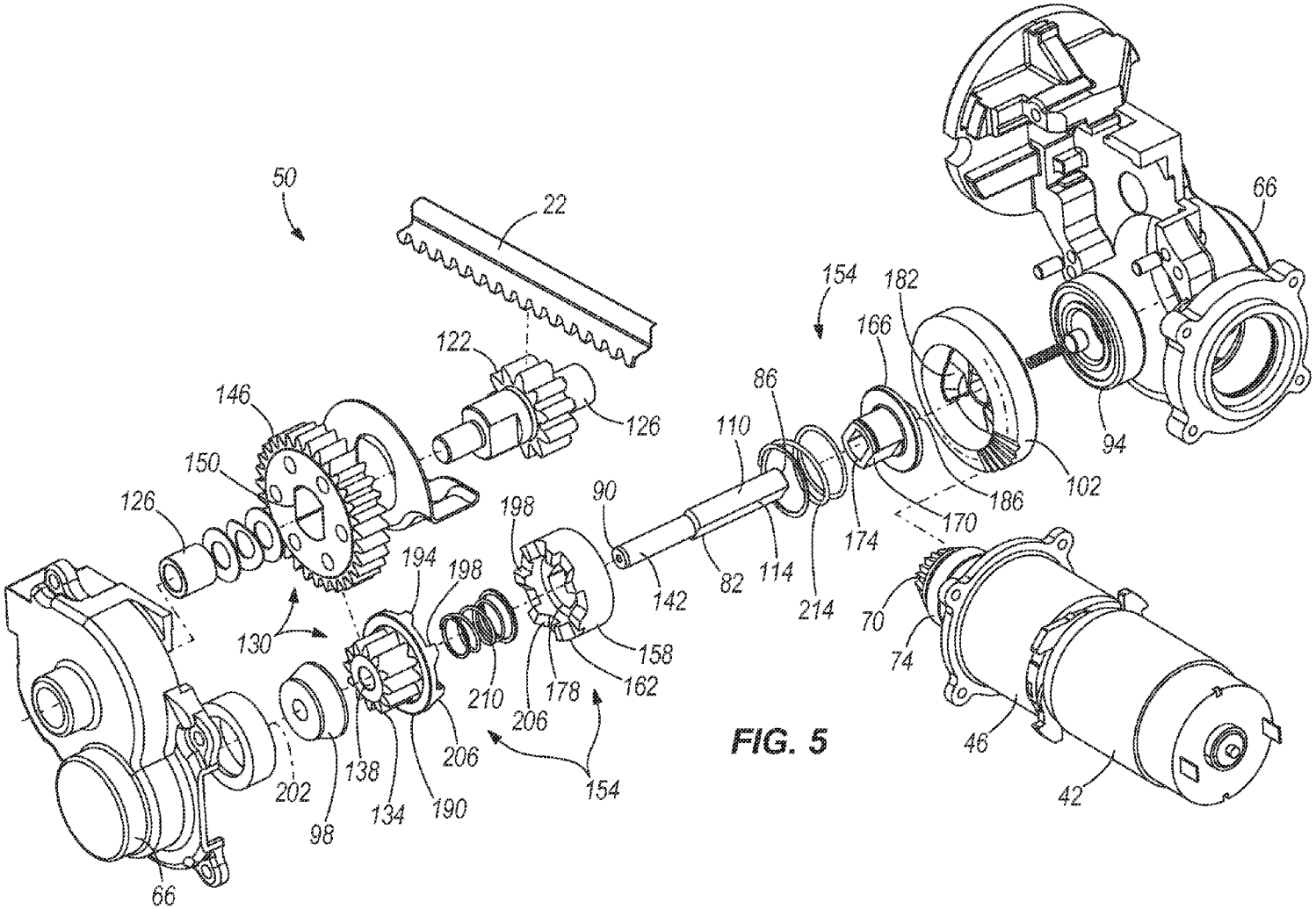
FIG. 5 is an exploded, rear perspective view of the transmission of FIG. 4.

With reference to FIGS. 4 and 5, the transmission 50 includes a transmission housing 66 and a pinion 70 supported for rotation in the transmission housing 66 by two roller bearings 74. The pinion 70 is coupled to an output carrier 78 of the planetary transmission 46 (FIG. 3) to receive torque therefrom. With reference to FIG. 4, the transmission 50 also includes a drive shaft 82 having opposed ends 86, 90 supported for rotation in the transmission housing 66 by respective bearings 94, 98, and an input ring 102 engaged with the pinion 70 and positioned coaxial with the drive shaft 82. The input ring 102 includes a hub 106 having a cylindrical outer periphery received within the inner race of the bearing 94 to journal the input ring 102 relative to the transmission housing 66. A drive portion 110 of the drive shaft 82 includes parallel flats 114, and the hub 106 of the input ring 102 includes opposed, convex lugs 118 that are engageable with the respective flats 114. As a result of this arrangement, the input ring 102 may be rotated by the pinion 70 relative to the drive shaft 82 a particular amount (e.g., 40 degrees) before the lugs 118 come into engagement with the respective flats 114, after which time the drive shaft 82 and the input ring 102 will co-rotate.

With reference to FIGS. 4 and 5, the transmission 50 also includes an output gear 122 engaged with the rack 22 and supported for rotation in the transmission housing 66 with bushings 126, and a speed-reducing gear train 130 coupled to the output gear 122. In the illustrated construction of the tool 10, the gear train 130 includes a first gear 134 having a cylindrical aperture 138 through which a cylindrical portion 142 of the drive shaft 82 is inserted. As such, the first gear 134 is journaled for rotation relative to the cylindrical portion 142 of the drive shaft 82. The gear train 130 also includes a second gear 146 having a non-circular aperture 150 in which a portion of the output gear 122 having a corresponding non-circular cross-sectional shape is received. As such, the output gear 122 and the second gear 146 of the gear train 130 are coupled for co-rotation. An interference or press-fit may be utilized to secure the output gear 122 to the second gear 146. Alternatively, any of a number of different mechanical fasteners may be utilized to secure the output gear 122 to the second gear 146, or as a further alternative, the output gear 122 may be integrally formed with the second gear 146 as a single piece.

With continued reference to FIGS. 4 and 5, the transmission 50 further includes a clutch 154 that is engaged in response to rotation of the motor 42 in a first direction corresponding with powered translation of the rack 22 in a forward or advancing direction to dispense material from a cartridge supported in the cartridge housing 18. The clutch 154 includes a clutch or an input member 158 having a plurality of axially extending teeth 162 and a slide member 166 positioned between the input member 158 and the input ring 102. The slide member 166 includes a hub 170 having an aperture 174 with a cross-sectional shape corresponding to that of the drive portion 110 of the drive shaft 82. Accordingly, the slide member 166 is axially slidable on the drive portion 110 and fixed for co-rotation with the drive shaft 82. The input member 158 includes an aperture 178 with a cross-sectional shape corresponding with the outer periphery of the hub 170 on the slide member 166. The hub 170 is received within the aperture 178 in a manner permitting relative axial movement between the slide member 166 and the input member 158, and fixing the input member 158 for co-rotation with the slide member 166. As such, both the input member 158 and the slide member 166 co-rotate with the drive shaft 82 at all times.

With reference to FIG. 5, the input ring 102 includes three ramps 182 (only one of which is visible) extending toward the slide member 166 that are selectively engageable with three corresponding ramps 186 on the slide member 166 (FIG. 4) in response to relative rotation between the input ring 102 and the slide member 166. The slide member 166 is therefore movable along the drive shaft 82 between a retracted position, in which the ramps 182, 186 are misaligned (i.e., not engaged), and an extended position, in which the ramps 182, 186 are aligned (i.e., engaged).

With reference to FIGS. 4 and 5, the clutch 154 also includes a clutch or an output member 190 coupled for co-rotation with the first gear 134 of the speed-reducing gear train 130. In the illustrated construction of the tool 10, the output member 190 is integrally formed with the first gear 134 as a single piece. Alternatively, any of a number of different mechanical connections may be utilized to couple the output member 190 and the first gear 134 (e.g., a press-fit, welding, a key and keyway arrangement, adhesives, fasteners, etc.). The output member 190 shares a hub with the first gear 134, and further includes a circular rim having a plurality of axially extending teeth 194 in facing relationship with the teeth 162 on the input member 158. Sufficient clearance exists between the cylindrical portion 142 of the drive shaft 82 and the output member 190 such that the output member 190 is rotatable, with the first gear 134, relative to the drive shaft 82. Each of the teeth 162, 194 on the respective input and output members 158, 190 includes a drive surface 198 on one side that is oriented generally parallel to a rotational axis 202 of the drive shaft 82, and a ramp surface 206 on the other side that is generally inclined relative to the rotational axis 202. When the input member 158 rotates in a counter-clockwise direction from the frame of reference of FIG. 4 to engage the respective drive surfaces 198 of the teeth 194, torque is transferred from the input member 158 to the output member 190. The ramp surfaces 206 of the respective teeth 162, 194 are not intended to be used during the normal course of operation of the tool 10, but rather are provided as a measure to prevent torque transfer between the input and output members 158, 190 should the output member 190 overrun the input member 158 (e.g., when the rack 22 is manually advanced by the operator of the tool 10).

With reference to FIGS. 4 and 5, the clutch 154 also includes a return spring 210 positioned between the input member 158 and the output member 190 to bias the input member 158 toward the input ring 102, and a delay spring 214 positioned between the slide member 166 and the input member 158. When the slide member 166 is in the extended position, the delay spring 214 biases the input member 158 toward a corresponding extended position to engage the output member 190. However, when the slide member 166 is in the retracted position, the input member 158 is returned to a corresponding retracted position by the return spring 210 such that sufficient spacing exists between the input member 158 and the output member 190 to prevent engagement of the respective teeth 162, 194 on the input and output members 158, 190.

Figure 10:
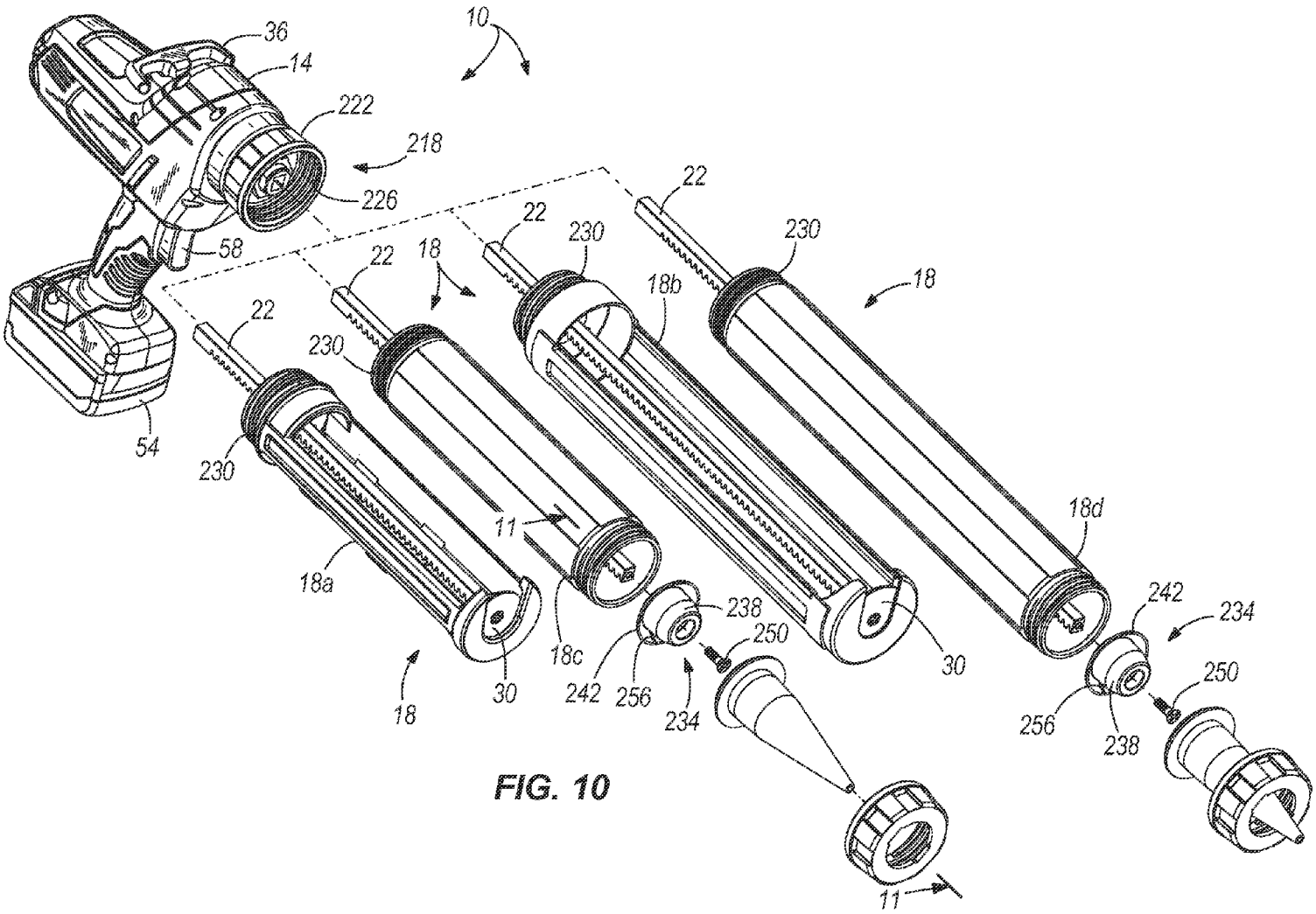
FIG. 10 is a front perspective view of the powered dispensing tool of FIG. 1, illustrating various combinations of cartridge housings and plungers that may be used with the tool.

With reference to FIG. 10, the powered dispensing tool 10 includes a quick-change assembly 218 for adapting different style and size cartridge housings 18 to the main housing 14 of the tool 10 such that the tool 10 may be used with cardboard tube-style cartridges 18*a*, 18*b* or sausage pack cartridges 18*c*, 18*d* of different sizes. In the illustrated construction of the tool 10, the quick-change assembly 218 is configured as a collar 222 with internal threads 226 that is axially secured to the main housing 14 of the tool 10. The collar 222, however, is free to rotate relative to the housing 14. The cartridge housings 18*a*, 18*b* are adapted to receive cardboard tube-style cartridges, and the cartridge housings 18*c*, 18*d* are adapted to receive sausage pack cartridges. Each of the housings 18 includes a universal connector having external threads 230 that correspond with the internal threads 226 on the collar 222, such that any of the housings 18 may be secured to the main housing 14. No additional structure is utilized to interlock the housings 18 to the collar 222 to inhibit inadvertent removal of any of the housings 18 from the collar 222 and the main housing 14.

Figure 11:
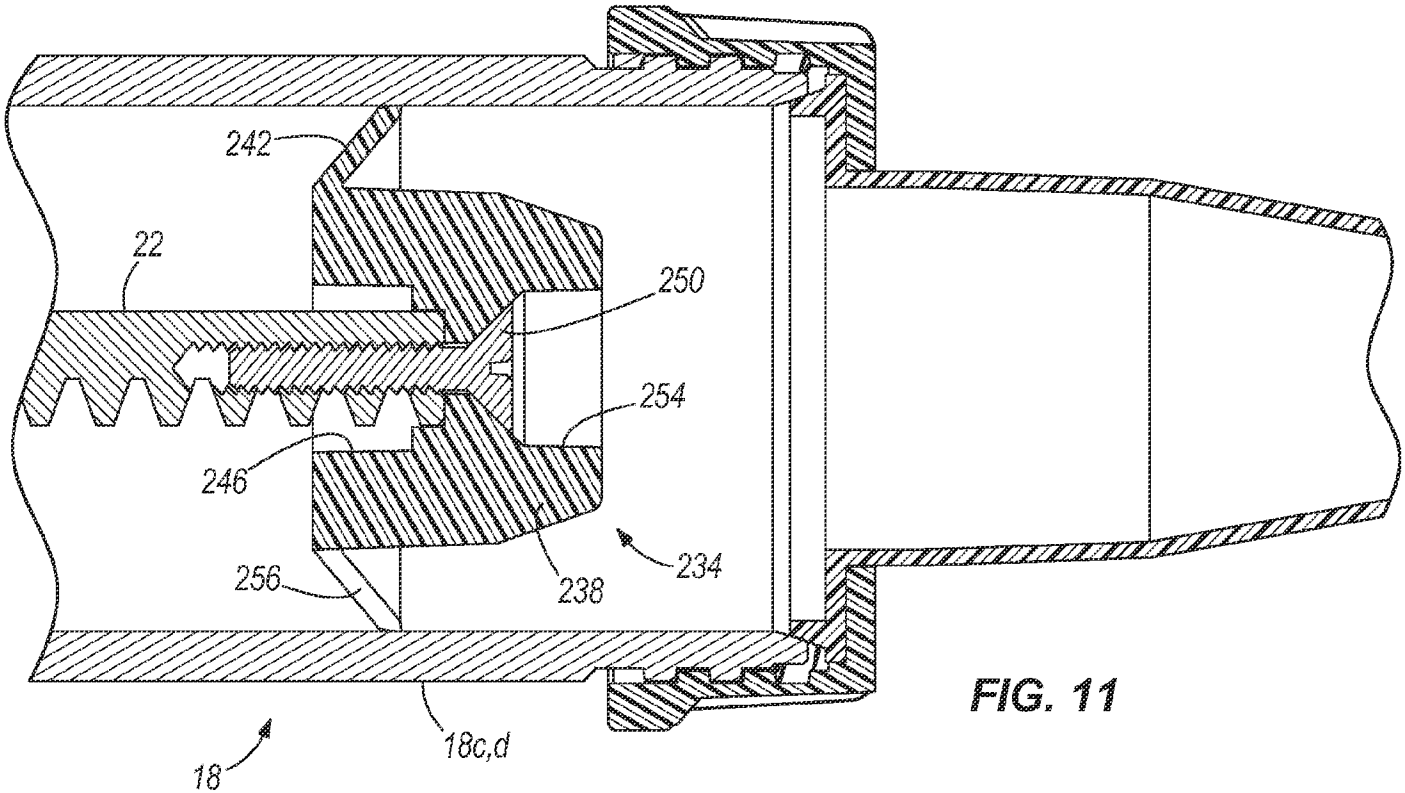
FIG. 11 is an enlarged, cross-sectional view of one of the plungers shown in FIG. 10 attached to the rack.

Likewise, the plunger 30 may be replaced with other plungers having different sizes or configurations than the plunger 30. The plunger 30 illustrated in FIGS. 1 and 2 is configured for use with cardboard tube-style cartridges and either of the cartridge housings 18*a*, 18*b* shown in FIG. 10. Another plunger 234 is used in conjunction with the either of the cartridge housings 18*c*, 18*d* when dispensing material from a sausage pack. As shown in FIGS. 10 and 11, the plunger 234 includes a central, tapered dome 238 and a circular seal lip 242 extending from the dome 238. The dome 238 includes a cylindrical bore 246 facing the rear end of the plunger in which the rack 22 is received (FIG. 11). A fastener (e.g., a screw 250) is received within a recess 254 facing the forward end of the plunger 234 to secure the plunger 234 to the rack 22. The lip 242 includes a single, radially extending slot 256 (FIGS. 10 and 11) through which air may vent from one side of the plunger 234 to the other side of the plunger 234 when the plunger 234 is situated in one of the sausage pack-style cartridge housings 18*c*, 18*d* shown in FIG. 10.

Figure 12:
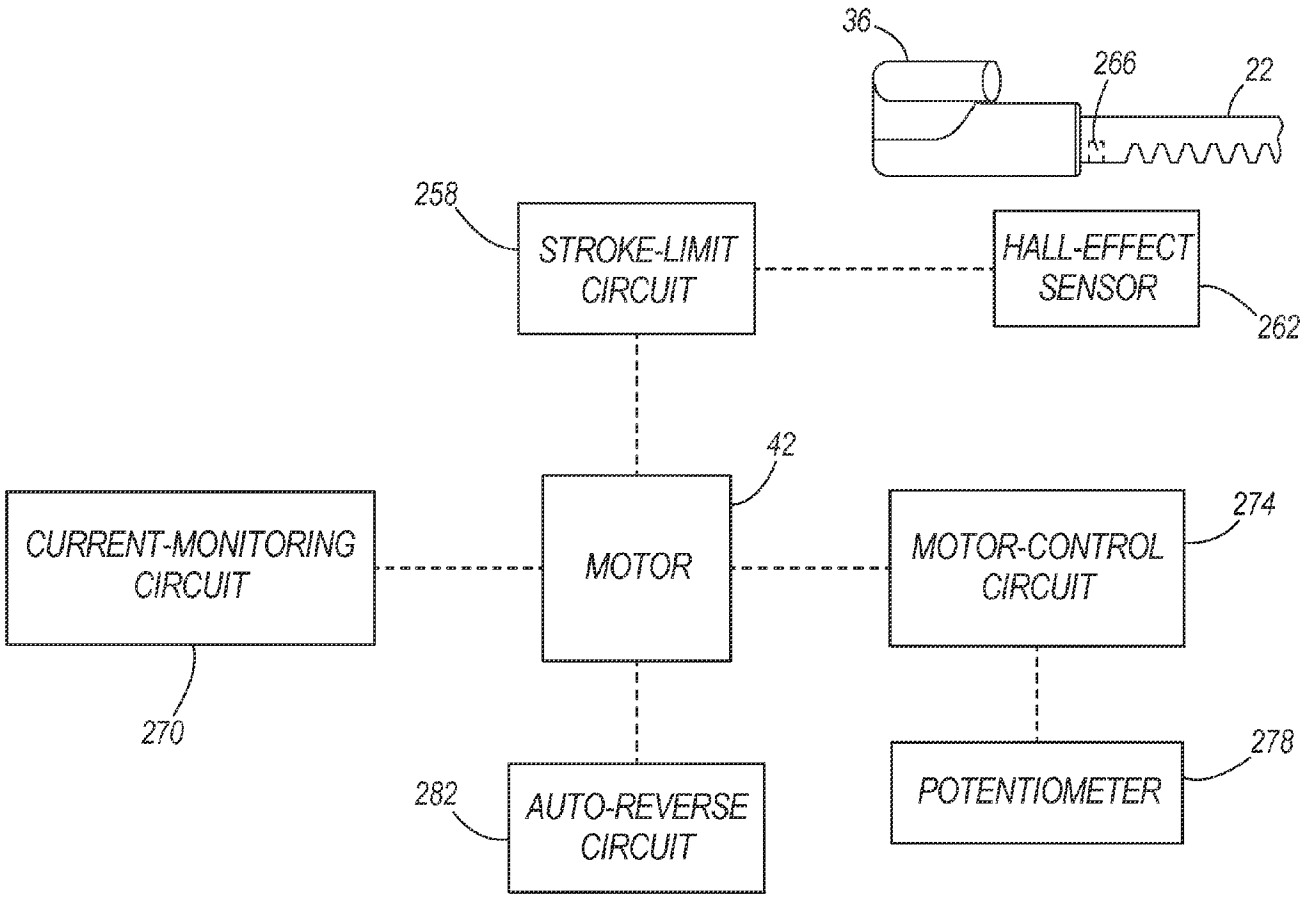
FIG. 12 is a schematic illustrating various electronic components of the powered dispensing tool of FIG. 1.

With reference to FIG. 12, the tool 10 further includes a stroke-limit circuit 258 in electrical communication with the motor 42, a Hall-effect sensor 262 in electrical communication with the stroke-limit circuit 258, and a magnet 266 coupled to the rack 22 at a location proximate the end 34 of the rack 22 opposite the plunger 30. Although not shown, the stroke-limit circuit 258 may be a component of a top-level or master controller in the tool 10. Though schematically illustrated in FIG. 12, the magnet 266 may be coupled to the rack 22 in any of a number of different manners (e.g., using a press-fit, adhesives, fasteners, etc.). The magnet 266 may also be at least partially positioned within the rack 22 such that little to none of the magnet 266 is visible from the outer periphery of the rack 22.

Upon detection of the magnetic field emanated by the magnet 266, the Hall-effect sensor 262 is actuated which, in turn, provides a signal to the stroke-limit circuit 258 to deactivate the motor 42. In this manner, the end 34 of the rack 22 opposite the plunger 30 is prevented from impacting the main housing 14 during advancement of the rack 22 or movement of the rack 22 in a forward, material-dispensing direction, thereby defining a predetermined stroke limit to the rack 22 and plunger 30.

With continued reference to FIG. 12, the tool 10 also includes a current-monitoring circuit 270 in electrical communication with the motor 42. Although not shown, the current-monitoring circuit 270 may be a component of a top-level or master controller in the tool 10. Alternatively, the current-monitoring circuit 270 may be a separate and stand-alone circuit not associated with any other controllers in the tool 10.

The rack 22 undergoes a relatively slow linear motion for dispensing caulk, adhesives, or other materials from cartridges. This slow linear dispensing speed is produced by reducing the motor speed through the planetary transmission 46 and the speed-reducing gear train 130, followed by the output gear 122 driving the rack 22. In normal operation, the force developed by the rack 22 is within an acceptable range that will not affect the reliability of the tool 10. However, if the rack 22 encounters an obstacle that causes the motor speed to slow dramatically or stall completely, the amount of force developed by the rack 22 will increase substantially over a short period of time. Such an increased force may be large enough to damage to the planetary transmission 46, the rack 22, or the cartridge housing 18. The current-monitoring circuit monitors 270 this force and quickly takes corrective action should the force become too high.

The force developed by the rack 22 is proportional to the torque developed by the motor 42 which, in turn, is proportional to the motor current. Therefore, monitoring motor current provides a very good indication of the force exerted on the rack 22. If a motor current feedback signal rises at a rate higher than a predetermined value, the current-monitoring circuit 270 will cease to drive the motor 42 and the rack 22 in the forward, material-dispensing direction, and will instead drive the motor 42 and the rack 22 in a reverse direction for a short interval before deactivating the motor 42. This condition may occur, for example, if a blockage is encountered within the cartridge which, in turn, prevents material from being discharged from the cartridge. A process for monitoring motor current, which can be implemented in the current-monitoring circuit 270 of FIG. 12, is shown and described in greater detail in published U.S. Patent Application No. 2010/0001017 (the "'017 Publication"), the entire contents of which is hereby incorporated by reference.

With continued reference to FIG. 12, the tool 10 further includes a motor-control circuit 274 in electrical communication with the motor 42. Although not shown, the motor-control circuit 274 may be a component of a top-level or master controller in the tool 10. Alternatively, the motor-control circuit 274 may be a separate and stand-alone circuit not associated with any other controllers in the tool 10.

When the trigger 58 is depressed, the motor-control circuit 274 activates the motor 42. However, rather than immediately driving the motor 42 at a predetermined speed, or at a user-selected speed in accordance with the adjustment of a potentiometer 278 (FIG. 12) in communication with the motor-control circuit 274, a soft-start feature of the dispensing tool 10 allows the rack 22, moving in the forward or material-dispensing direction, to be accelerated from rest to the predetermined or user-selected speed over a short period of time (i.e., typically less than one second). The motor-control circuit 274 gradually increases the voltage applied to the motor 42, and in doing so reduces the peak current drawn by the motor 42 during startup. The motor-control circuit 274 also reduces the peak torque delivered by the motor 42 during startup, and therefore provides smoother dispensing of material during startup. Further, incorporating the soft-start feature in the motor-control circuit 274 increases the life expectancy and reduces wear of the tool 10. A process for providing the soft-start feature, which can be implemented in the motor-control circuit 274 of FIG. 12, is shown and described in greater detail in the '017 Publication.

With continued reference to FIG. 12, the tool 10 also includes an auto-reverse circuit 282 in electrical communication with the motor 42. Although not shown, the auto-reverse circuit 282 may be a component of a top-level or master controller in the tool 10. Alternatively, the auto-reverse circuit 282 may be a separate and stand-alone circuit not associated with any other controllers in the tool 10.

It is desirable to minimize or eliminate dispensing material from excreting from the tool 10 after operation has ceased. This can be achieved by providing a control scheme for momentarily reversing the rotational direction of the motor 42 after the user has released the trigger 58. After dispensing is halted, the material within the cartridge is allowed to expand within the cartridge to alleviate the residual pressure within the cartridge from the dispensing operation. As is described in greater detail below, momentary reversal of the motor 42 by the auto-reverse circuit 282 causes the clutch 154 to disengage, thereby disconnecting the rack 22 from the motor 42. The plunger 30 and the rack 22 may therefore be pushed rearward by the expanding material within the cartridge without concern of back-driving the motor 42.

Figure 6:
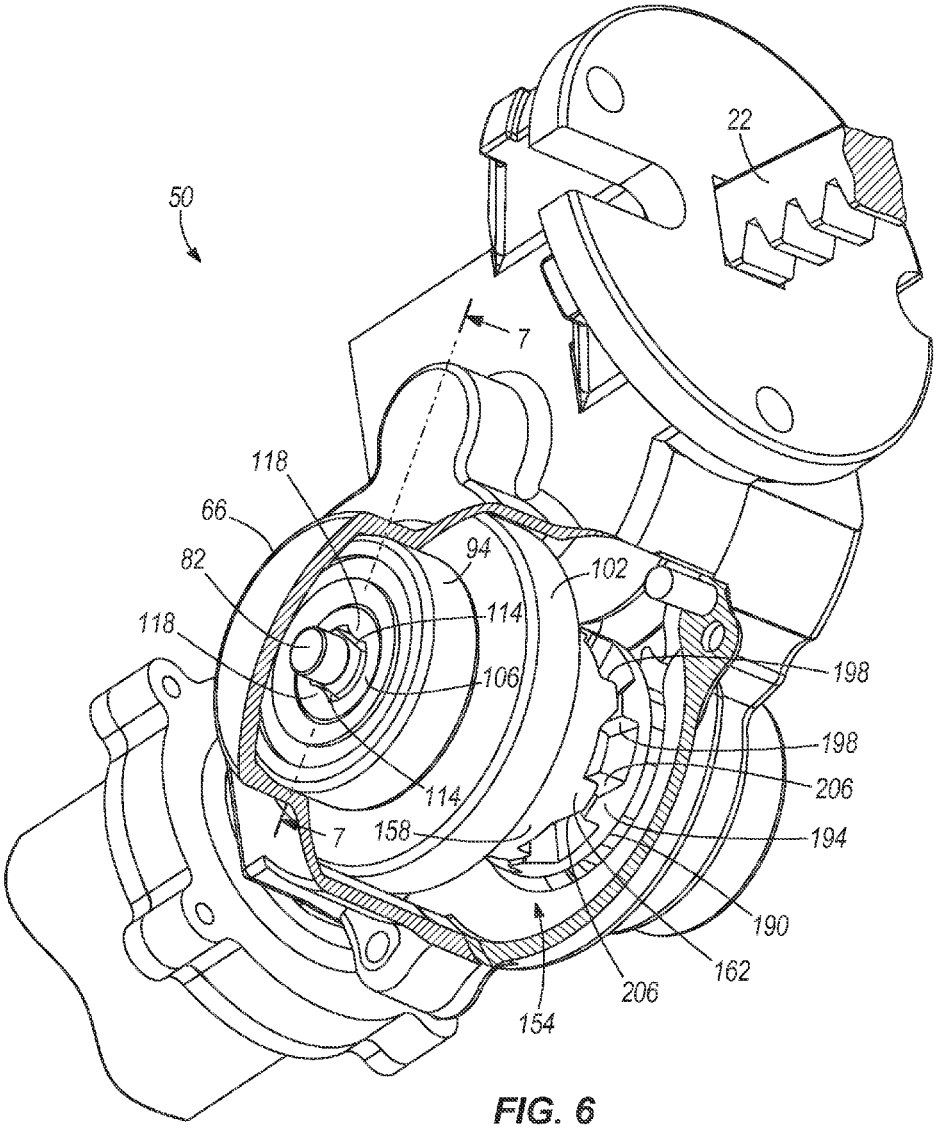
FIG. 6 is a cutaway view of the powered dispensing tool of FIG. 1, illustrating the orientation of an input ring and a drive shaft of the transmission when a motor of the dispensing tool is deactivated.
Figure 7:
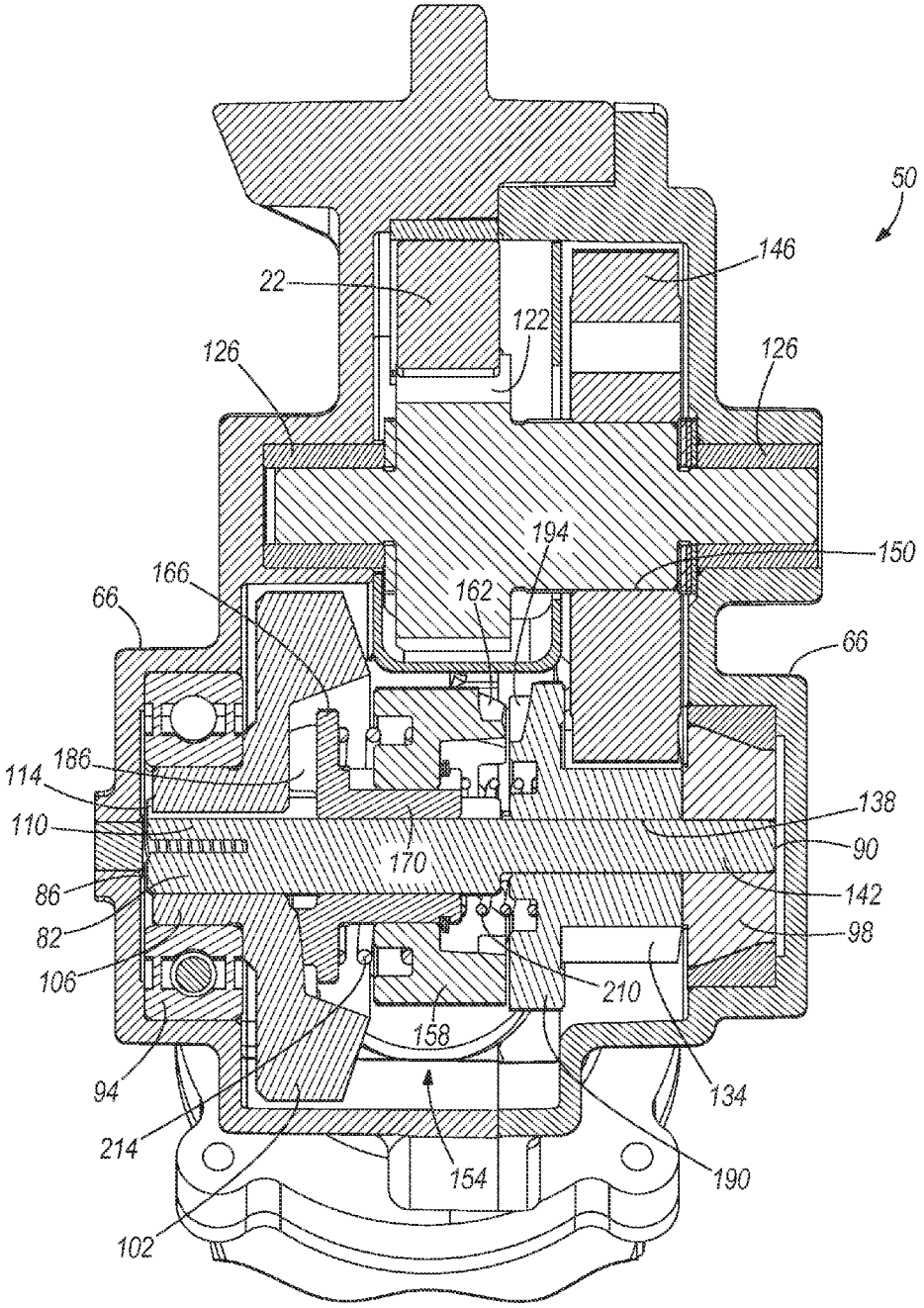
FIG. 7 is a partial cross-sectional view of the powered dispensing tool of FIG. 1 along line 7-7 in FIG. 6, illustrating a clutch of the transmission in a disengaged configuration corresponding with the orientation of the input ring and drive shaft shown in FIG. 6.

In operation of the tool 10, the input ring 102 is initially oriented relative to the drive shaft 82 such that the lugs 118 are spaced from the respective flats 114 on the drive shaft 82 (FIG. 6), and the output member 190 is in its retracted position (FIG. 7). As such, the output member 190, the speed-reducing gear train 130, and the output gear 122 may be rotated relative to the drive shaft 82 in response to the operator grasping the end 34 of the rack 22 opposite the plunger 30 and pulling the rack 22 rearward to create sufficient spacing in the cartridge housing for insertion of a tubular cartridge or a sausage pack containing caulk, adhesive, or other material to be dispensed. After the tubular cartridge or sausage pack is loaded, the rack 22 may be pushed forward to initially engage the plunger 30 with the rear of the tubular cartridge or sausage pack, causing the output member 190, the speed-reducing gear train 130, and the output gear 122 to rotate relative to the stationary drive shaft 82.

Figure 8:
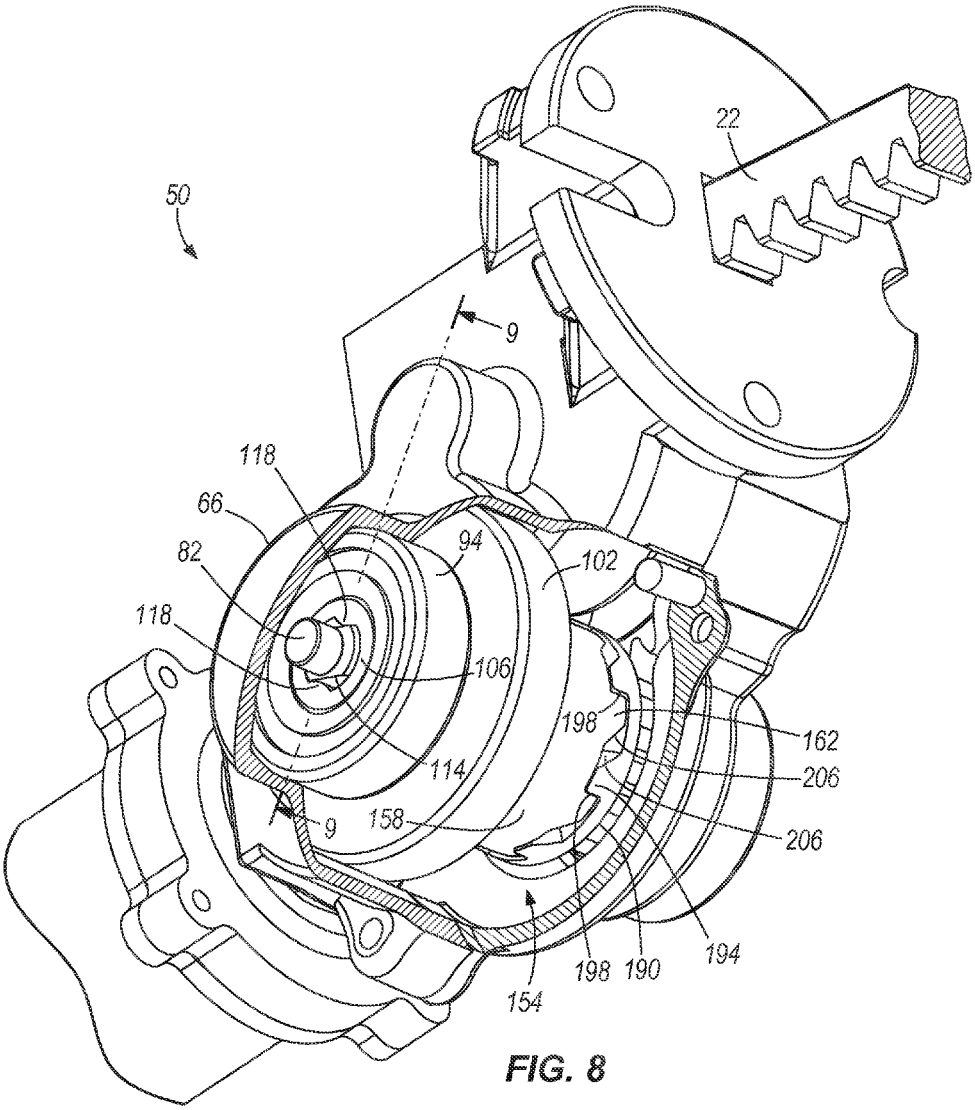
FIG. 8 is a cutaway view of the powered dispensing tool of FIG. 1, illustrating the orientation of the input ring and the drive shaft after the motor is activated.
Figure 9:
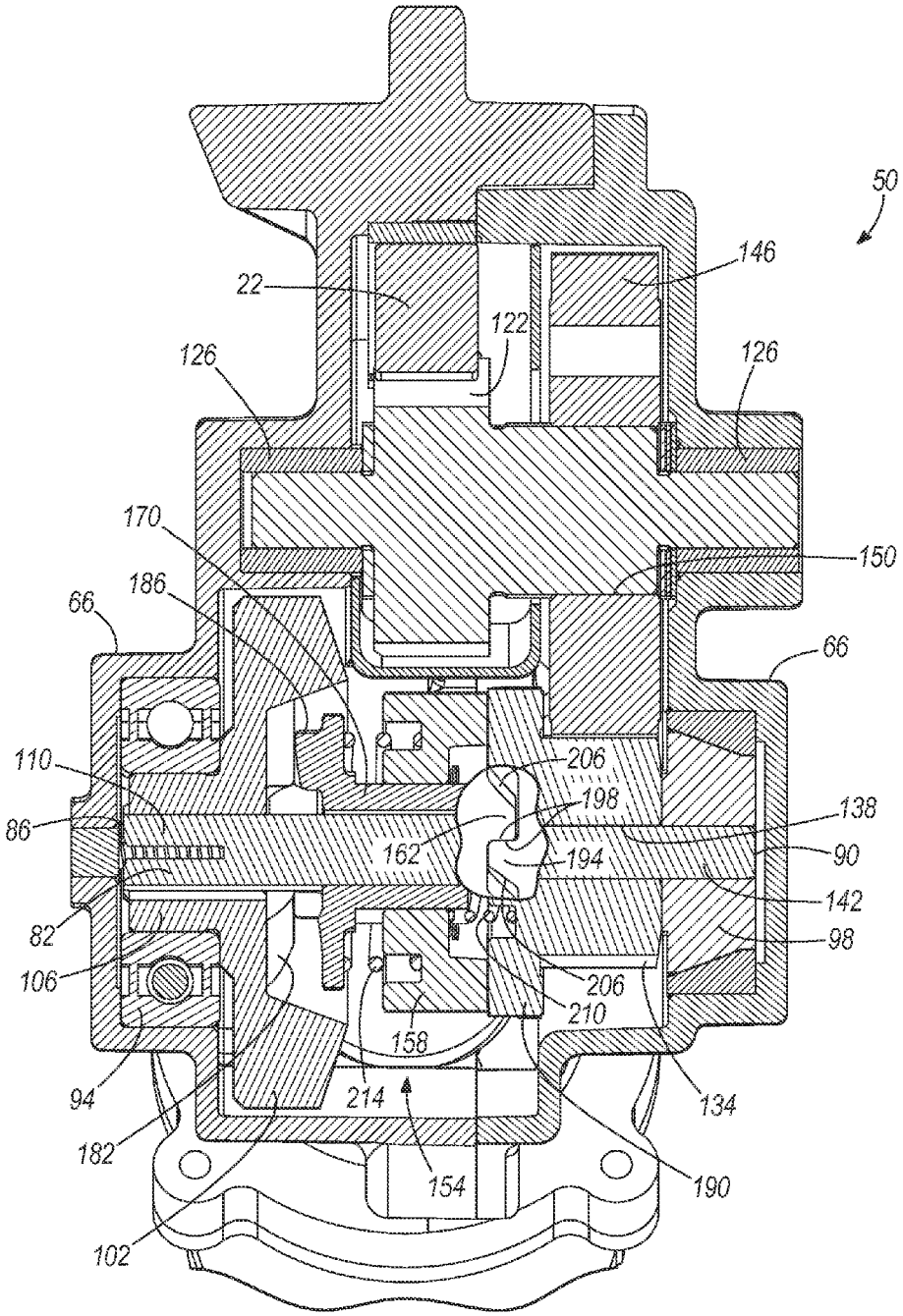
FIG. 9 is a partial cross-sectional view of the powered dispensing tool of FIG. 1 along line 9-9 in FIG. 8, illustrating the clutch in an engaged configuration corresponding with the orientation of the input ring and drive shaft shown in FIG. 8.

When the user depresses the trigger 58, the motor 42 is activated to drive the planetary transmission 46, the pinion 70, and the input ring 102. As discussed above, the motor-control circuit 274 may implement the soft-start feature to slowly accelerate the motor 42 to a desired operating speed. The input ring 102 will continue to rotate relative to the stationary drive shaft 82 until the lugs 118 engage the respective flats 114 on the drive shaft 82 (i.e., after about 40 degrees of relative rotation; see FIG. 8). During this time, the ramps 186, 182 on the slide member 166 and the input ring 102 are rotated into alignment and engage, thereby axially displacing the slide member 166 from its retracted position (FIG. 7) to its extended position (FIG. 9). If the teeth 162 of the input member 158 are aligned with the respective teeth 194 on the output member 190, the delay spring 214 is compressed. Rotation of the drive shaft 82, the slide member 166, and the input member 158 continues until the teeth 162 of the input member 158 are misaligned with the respective teeth 194 on the output member 190, at which time the delay spring 214 rebounds to cause the input member 158 to engage the output member 190.

Subsequent engagement of the drive surfaces 198 on the respective teeth 162, 194 of the input and output members 158, 190 rotationally interlocks the input member 158 and the output member 190. Torque from the drive shaft 82 is then transferred through the input member 158, through the output member 190, and to the speed-reducing gear train 130, which rotates the output gear 122 and drives the rack 22 in a forward direction to dispense caulk, adhesive, or other material from the tubular cartridge or sausage pack.

When the user releases the trigger 58, the auto-reverse circuit 282 momentarily drives the motor 42 in a reverse direction to rotate the input ring 102 relative to the drive shaft 82 in a reverse direction, thereby disengaging the lugs 118 from the respective flats 114 on the drive shaft 82. During this time, the ramps 186, 182 on the slide member 166 and the input ring 102 are misaligned and disengaged, permitting the return spring 210 to bias the input member 158 and slide member 166 toward their respective retracted positions, thereby disengaging the input member 158 from the output member 190. The output member 190, therefore, is again permitted to rotate relative to the drive shaft 82 in response to retraction of the rack 22 caused by expansion of the caulk, adhesive, or other material to be dispensed within the cartridge supported within the cartridge housing 18. Should the user of the tool 10 desire to change material cartridges, the user may grasp the end 34 of the rack 22 and pull to manually retract the rack 22 to change the cartridge.

Figure 13:
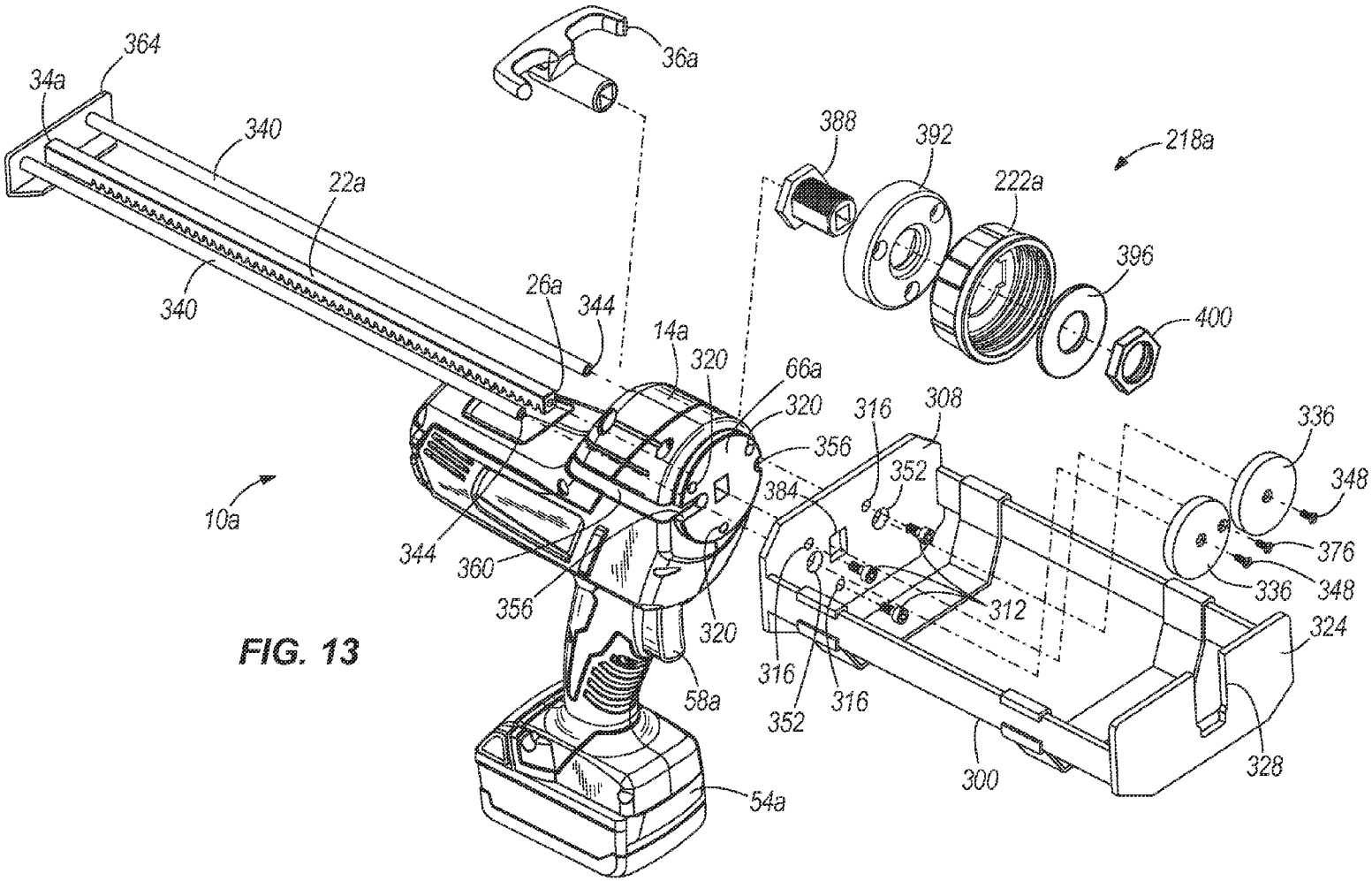
FIG. 13 is an exploded, front perspective view of a powered dispensing tool according to another embodiment of the invention, illustrating a two-component cartridge housing.
Figure 14:
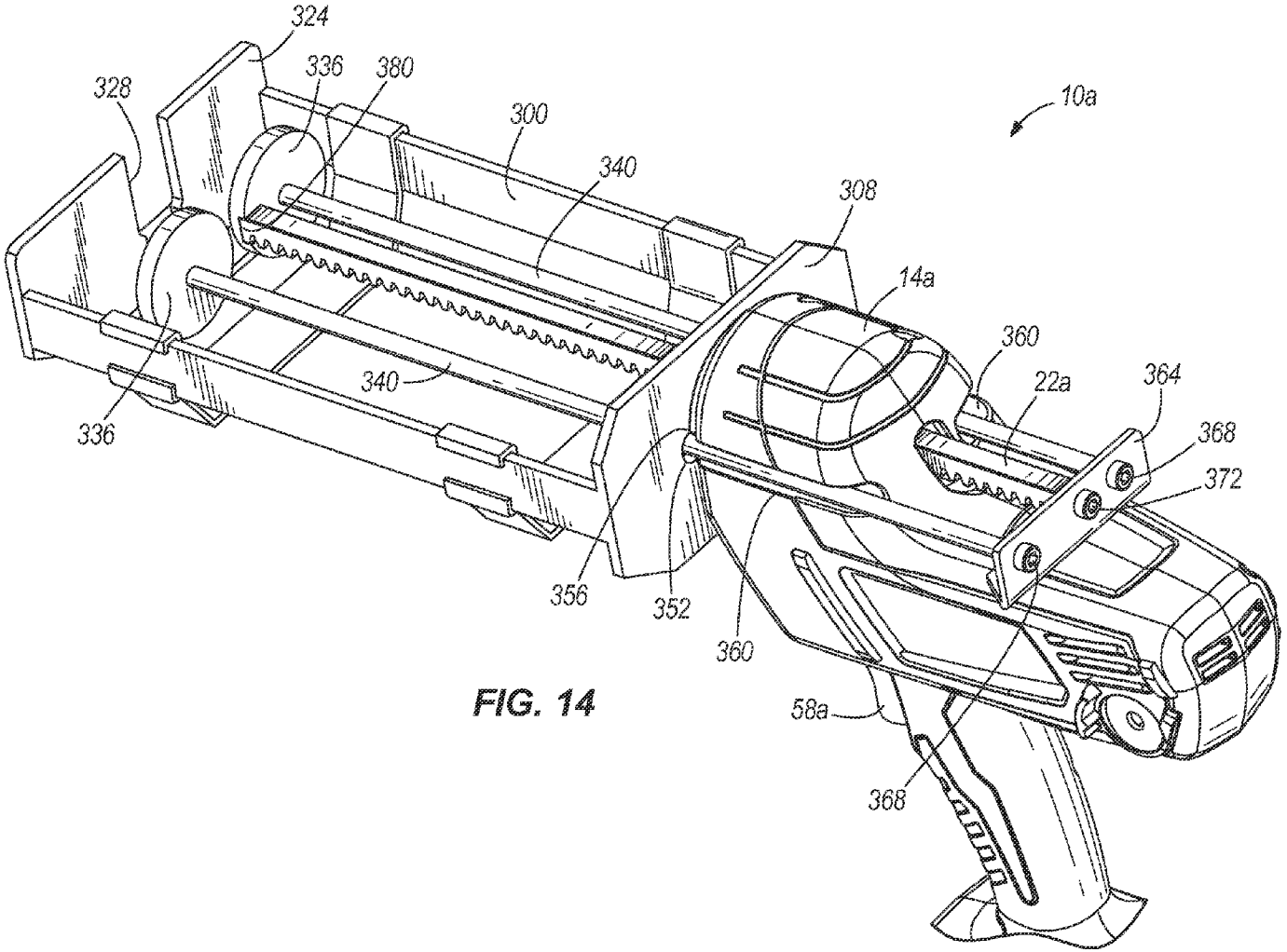
FIG. 14 is an assembled, rear perspective view of the powered dispensing tool of FIG. 13.
Figure 15:
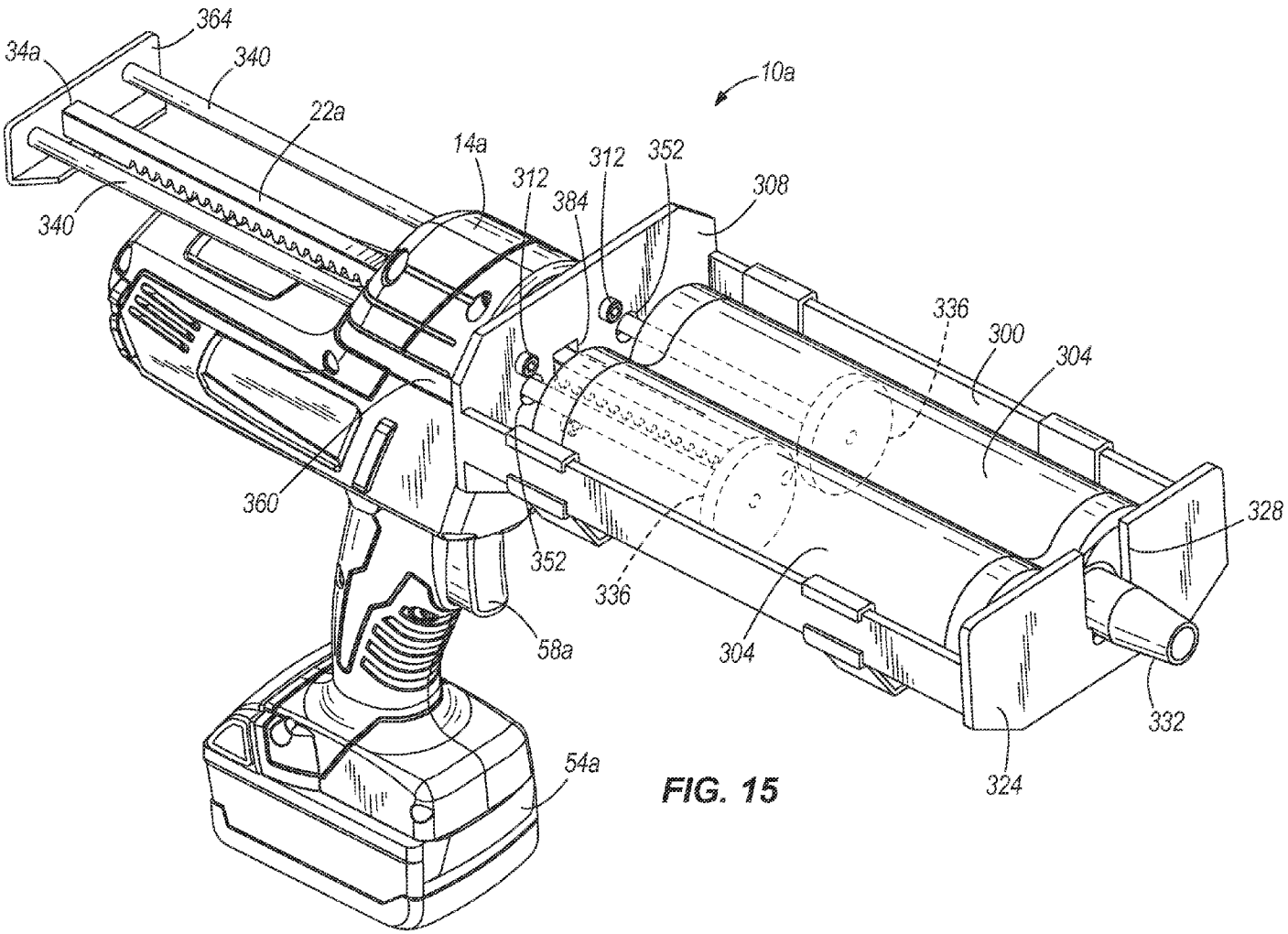
FIG. 15 is an assembled, front perspective view of the powered dispensing tool of FIG. 13 with dual material cartridges supported in the two-component cartridge housing.

FIGS. 13-15 illustrate a powered dispensing tool **10*a* according to another embodiment of the invention. Like components are identified with like reference numerals with the letter "a" and will not be described again in detail. The tool 10*a* includes a two-component cartridge housing 300 attached to the main housing 14*a* for supporting dual tubular cartridges 304 (FIG. 15) of caulk, adhesive, two-part epoxy, or other material to be dispensed in a side-by-side relationship. The cartridge housing 300 is sized to accommodate, for example, dual 11 ounce tubular cartridges 304. Alternatively, the cartridge housing 300 may be sized to accommodate differently sized tubular cartridges 304**.

With reference to FIG. 13, the cartridge housing 300 includes a rear end plate 308 that is coupled to the transmission housing **66*a*. In the illustrated construction of the tool 10*a*, the cartridge housing 300 is directly mounted to the transmission housing 66*a* using threaded fasteners 312. Particularly, the rear end plate 308 of the cartridge housing 300 includes three apertures 316 aligned with three corresponding threaded bores 320 in the transmission housing 66*a*, and the threaded fasteners 312 (e.g., screws, bolts, etc.) are inserted through the apertures 316 and received in the threaded bores 320, respectively. As such, the fasteners 312 interconnect the cartridge housing 300 and the transmission housing 66*a*, with the fasteners 312 being anchored within the transmission housing 66*a*. Alternatively, the cartridge housing 300 may be mounted to the transmission housing 66*a* through intermediate structure (e.g., a spacer, an auxiliary handle, etc.), or the cartridge housing 300 may be mounted to the transmission housing 66*a* using any of a number of different fasteners (e.g., quick-release fasteners, etc.). The cartridge housing 300 also includes a front end plate 324 having a notch 328 disposed in the middle of the end plate 324 in which a common nozzle 332 of the dual material cartridges 304 is received (FIG. 15**).

With reference to FIG. 13, the tool **10*a* also includes dual plungers 336 associated with the dual tubular cartridges 304 (FIG. 15), and corresponding rods 340 attached to the plungers 336. In the illustrated construction of the tool 10*a*, each of the rods 340 includes a threaded bore 344 at one end, and the plungers 336 are attached to the respective rods 340 using threaded fasteners 348 (e.g., screws, bolts, etc.) received in the threaded bores 344 (FIG. 13). Alternatively, any of a number of different structural arrangements may be utilized to interconnect the plungers 336 with the respective rods 340. The rods 340 extend through corresponding apertures 352 in the rear end plate 308, and through aligned notches 356, 360 in the transmission housing 66***a* and the main housing 14*a*, respectively (see also FIG. 14).

With reference to FIG. 13, the tool 10*a* further includes a handle 364 attached to the ends of the rods 340, respectively, opposite the plungers 336. As such, the handle 364 interconnects the rods 340 to ensure that the rods 340, and therefore the plungers 336, are movable together as a unit. In the illustrated construction of the tool 10*a*, the end of each of the rods 340 opposite the plungers 336 includes a threaded bore (not shown), and the handle 364 is secured to the rods 340 using threaded fasteners 368 (e.g., screws, bolts, etc.) received in the threaded bores of the rods 340 (FIG. 14). Alternatively, any of a number of different structural arrangements may be utilized to interconnect the handle 364 to the respective rods 340.

A rear end 34*a* of the rack 22*a* is also attached to the handle 364 using a threaded fastener 372 (e.g., a screw or bolt), while a front end 26*a* of the rack 22*a* is attached to one of the plungers 336 using another threaded fastener 376 (e.g., a screw or bolt; FIG. 13). As shown in FIG. 14, this plunger 336 includes a recess 380 in which the front end 26*a* of the rack 22*a* is received. Alternatively, the front end 26*a* of the rack 22*a* may be abutted with the rearmost surface of the plunger 336. The rear end plate 308 of the cartridge housing 300 also includes an aperture 384 through which the rack 22*a* is inserted (FIG. 13).

In operation of the tool 10*a*, powered translation of the rack 22*a* in a forward direction is directly imparted to the plunger 336 attached to the rack 22*a*, while powered translation of the rack 22*a* in the forward direction is indirectly imparted to both of the plungers 336 via the handle 364 and the respective rods 340. The plungers 336 are associated with the dual material cartridges 304, respectively, such that one of the plungers 336 is displaced through the tube of one of the material cartridges 304 as material is dispensed, and that the other plunger 336 and the rack 22*a* are displaced through the tube of the other of the material cartridges 304 as material is dispensed. The dispensed material from the two cartridges 304 is mixed in the common nozzle 332 (FIG. 15) and discharged as a single bead of material.

With reference to FIG. 13, the tool 10*a* is adaptable for use with either a single cartridge housing, such as any of the cartridge housings 18*a*-18*d* shown in FIG. 10 using the quick-change assembly 218*a*, or the two-component cartridge housing 300 shown in FIG. 13. As such, any of the single cartridge housings 18*a*-18*d* and the two-component cartridge housing 300 are interchangeably coupled to the transmission housing 66*a* to adapt the tool 10*a* for use with dual material cartridges 304 or single material cartridges. The quick-change assembly 218*a* includes a barrel nut 388 having a threaded outer periphery, a spacer 392, the collar 222*a*, a washer 396, and a nut 400 that is threaded to the barrel nut 388. The spacer 392, and therefore the barrel nut 388, are axially secured to the transmission housing 66*a* using the same fasteners 312 and the threaded bores 320 as described above for mounting the two-component cartridge housing 300 to the transmission housing 66*a*. The collar 222*a* is captured by the spacer 392 on one side and the washer 396 and nut 400 on the other side.

To adapt the tool 10*a* for use with the two-component cartridge housing 300, the quick-change assembly 218*a* must be removed from the main housing 14*a*, and the single plunger (e.g., either of plungers 30, 234; FIG. 10) and the handle 36*a* must be removed from the rack 22*a*. After the single plunger 30, 234 and the handle 36*a* are removed from the rack 22*a*, the quick-change assembly 218*a* may be removed from the main housing 14*a* by first unthreading the nut 400 from the barrel nut 388 to remove the washer 396 and the collar 222*a* (FIG. 13). Then, the fasteners 312 are unthreaded from the transmission housing 66*a* to permit the spacer 392 and the barrel nut 388 to be removed.

The two-component cartridge housing 300 is then mounted to the transmission housing 66*a* using the threaded fasteners 312, taking care to insert the rack 22*a* through the corresponding aperture 384 in the rear end plate 308. The rods 340 may be pre-assembled to the handle 364 which, in turn, is fastened to the rear end 34*a* of the rack 22*a* using the threaded fastener 372 (FIG. 14), taking care to align the rods 340 within the respective notches 356, 360 in the transmission housing 66*a* and the main housing 14*a*, and with the corresponding apertures 352 in the rear end plate 308 of the cartridge housing 300 (FIG. 13). Lastly, the plungers 336 are secured to the respective rods 340 using the threaded fasteners 348, and the front end 26*a* of the rack 22*a* is received within the recess 380 of the plunger 336 and secured to the plunger 336 using the threaded fastener 376. The user of the tool 10*a* may grasp the handle 364 to manually retract the rack 22*a*, the rods 340, and the plungers 336 as a unit until sufficient space within the two-component cartridge housing 300 is available. After insertion of the dual material cartridges 304 into the cartridge housing 300, operation of the tool 10*a* is identical to that described above in connection with the tool 10 of FIGS. 1-12.

Figure 16:
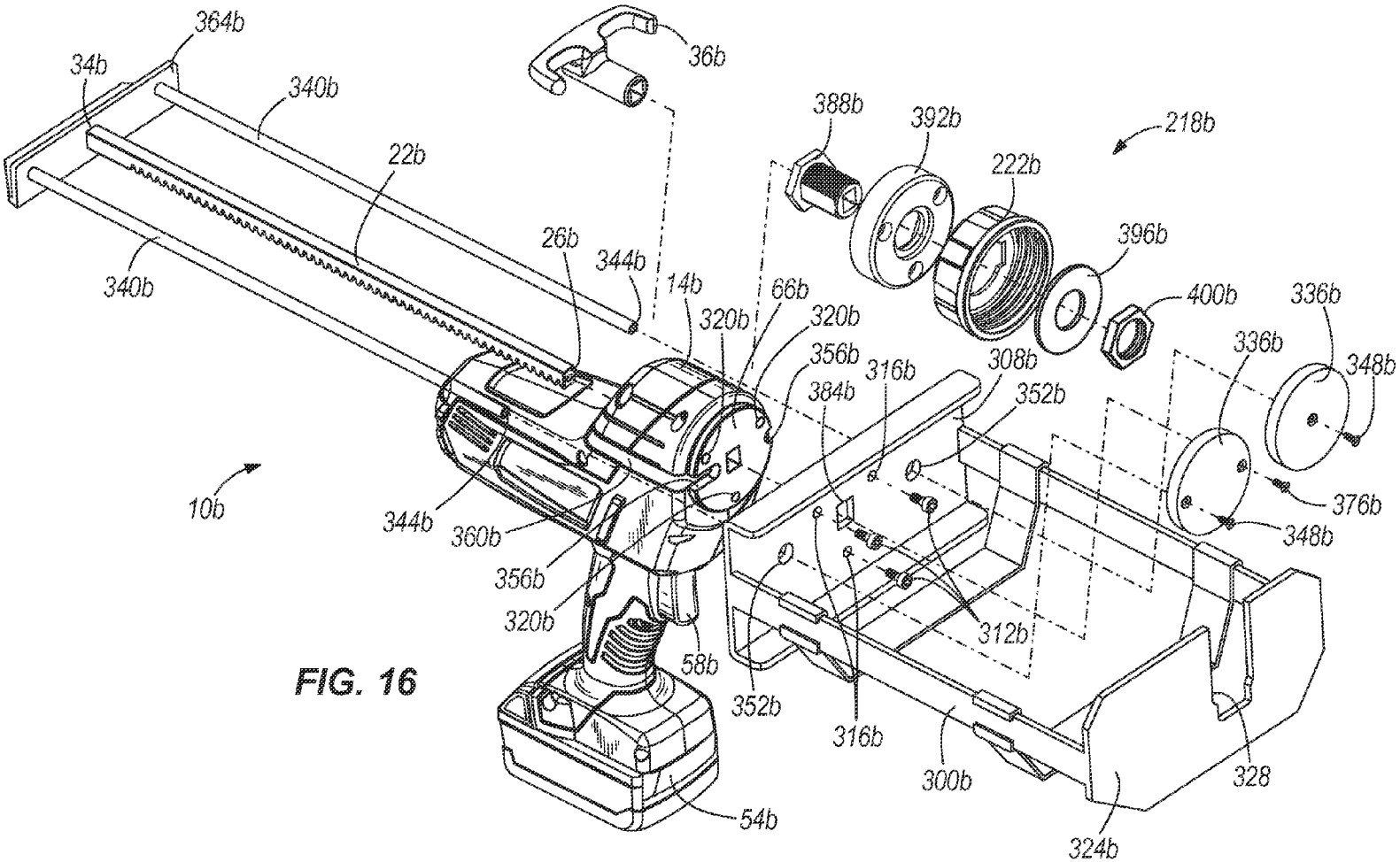
FIG. 16 is an exploded, front perspective view of a powered dispensing tool according to yet another embodiment of the invention, illustrating another two-component cartridge housing.
Figure 17:
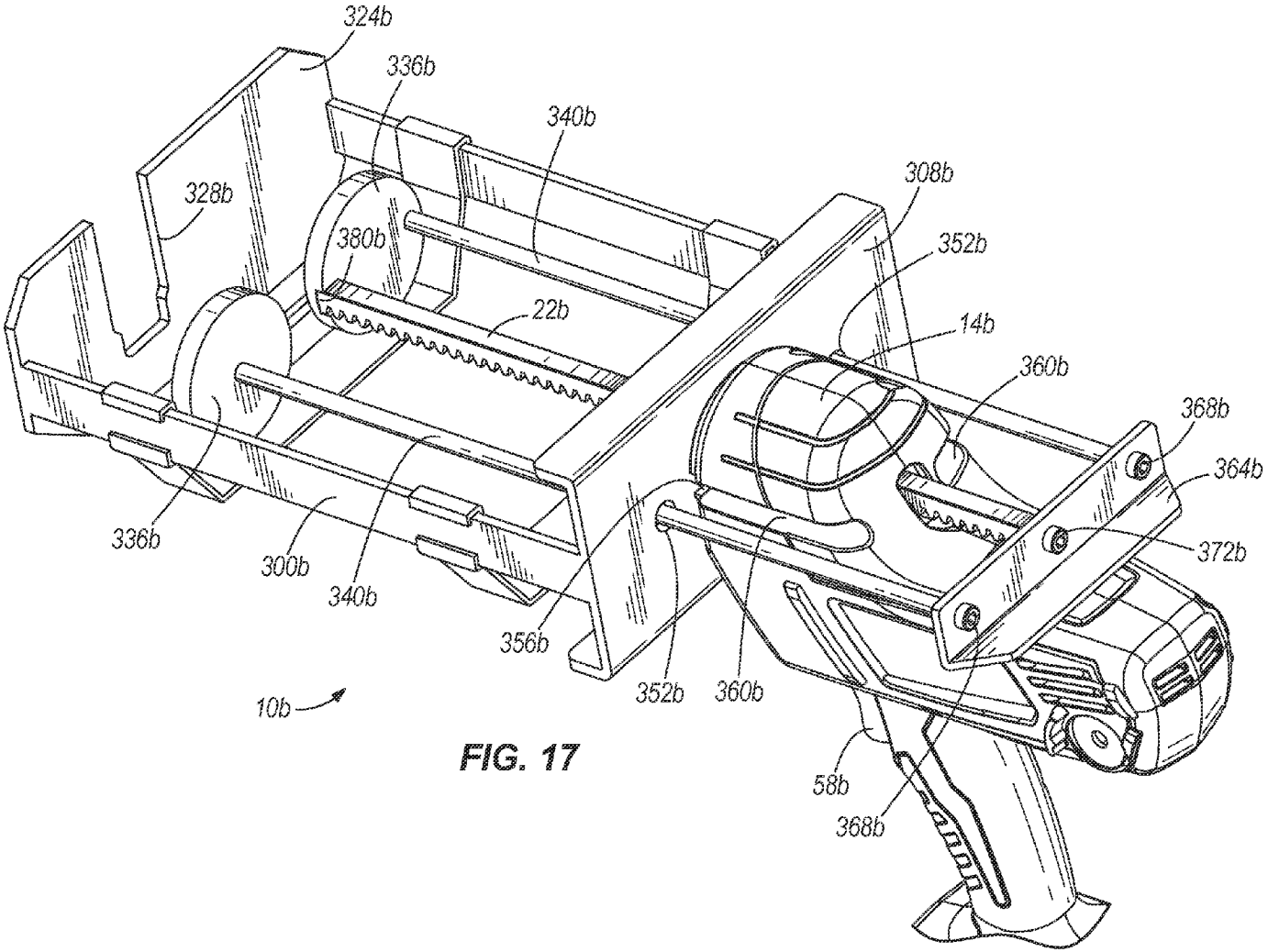
FIG. 17 is an assembled, rear perspective view of the powered dispensing tool of FIG. 16.
Figure 18:
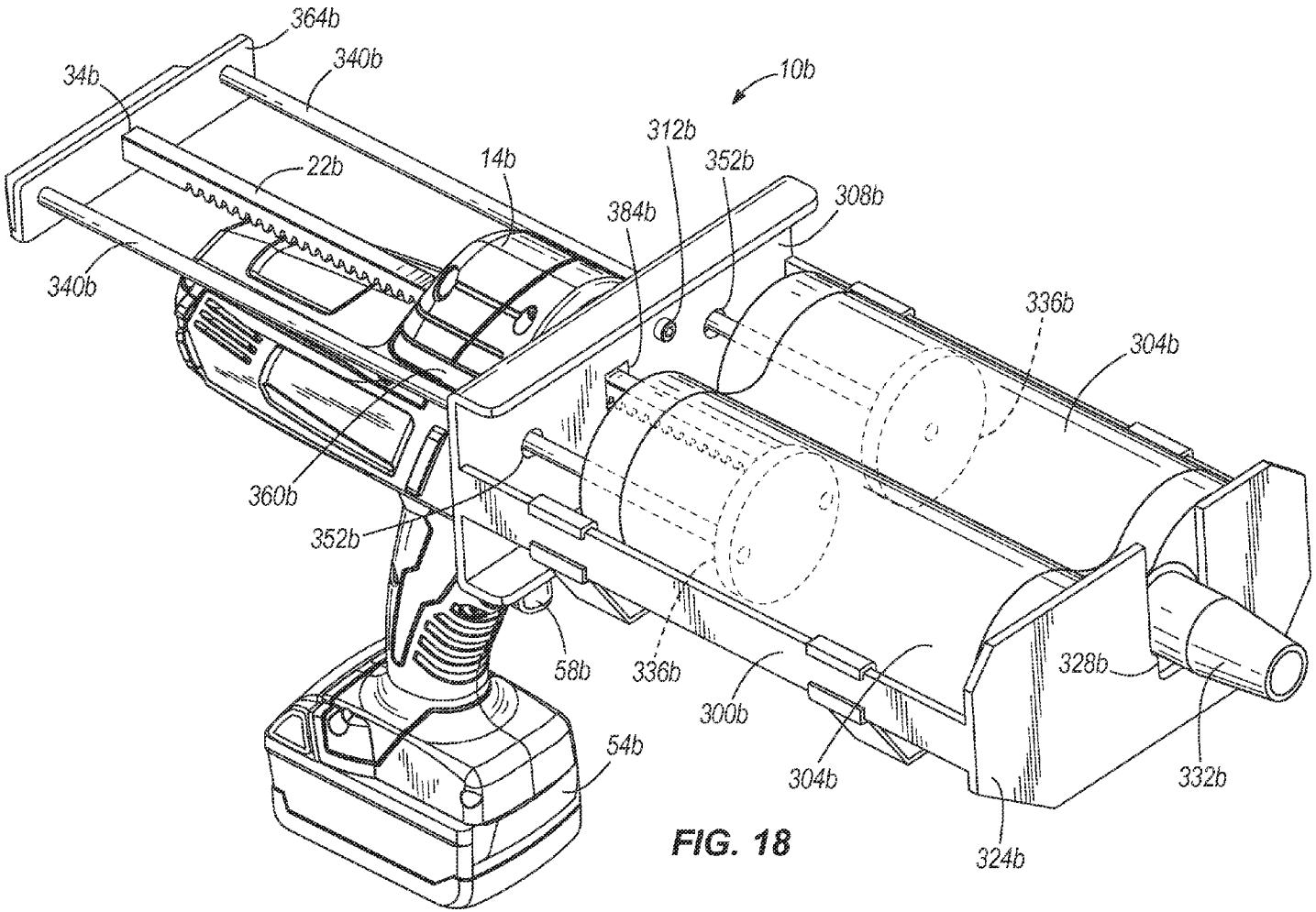
FIG. 18 is an assembled, front perspective view of the powered dispensing tool of FIG. 16 with dual material cartridges supported in the two-component cartridge housing.

FIGS. 16-18 illustrate a powered dispensing tool 10*b* according to yet another embodiment of the invention. Like components are identified with like reference numerals with the letter "b" and will not be described again in detail. The cartridge housing 300*b* is sized to accommodate, for example, dual 28 ounce tubular cartridges 304*b*. As such, the width of the cartridge housing 310*b* is greater than the width of the cartridge housing 300 of FIGS. 13-15. Therefore, the rods 340*b* are not received within the notches 356, 360 in the transmission housing 66*b* and the main housing 14*b*, respectively (FIGS. 16 and 17). Alternatively, the cartridge housing 300*b* may be sized to accommodate differently sized tubular cartridges 304*b*. Operation of the tool 10*b* is identical to that described above in connection with the tool 10*a* of FIGS. 13-15.

Although the invention has been described in detail with reference to certain preferred embodiments, variations and modifications exist within the scope and spirit of one or more independent aspects of the invention as described.

What is claimed is:

1. A powered dispensing tool comprising:

a housing;

a motor at least partially positioned within the housing;

a rack operably coupled to the motor for powered translation along a longitudinal axis in at least one of a forward direction and a reverse direction;

a transmission housing at least partially positioned within the housing through which the rack is extendable;

first and second plungers, at least one of which is coupled to one end of the rack;

a first cartridge housing within which first and second material cartridges may be supported in a side-by-side relationship, the first and second plungers being associated with the first and second material cartridges, respectively; and a second cartridge housing within which only a single material cartridge may be supported;

wherein the first and second cartridge housings are interchangeably coupled to the same transmission housing to adapt the tool for use with dual material cartridges or single material cartridges.

2. The powered dispensing tool of claim 1, further comprising a collar removably coupled to the transmission housing, wherein the second cartridge housing is attachable to the transmission housing via the collar when the collar is coupled to the transmission housing.

3. The powered dispensing tool of claim 2, wherein the second cartridge housing is attachable to the collar using a threaded connection.

4. The powered dispensing tool of claim 1, further comprising at least one fastener extending between the first cartridge housing and the transmission housing for interconnecting the first cartridge housing and the transmission housing, the fastener being anchored within the transmission housing.

5. The powered dispensing tool of claim 4, wherein the fastener is a threaded fastener.

6. The powered dispensing tool of claim 5, wherein the transmission housing includes a threaded bore in which the threaded fastener is at least partially received.

7. The powered dispensing tool of claim 6, wherein the first cartridge housing includes an aperture through which a shank of the threaded fastener protrudes.

8. The powered dispensing tool of claim 4, wherein the at least one fastener includes three fasteners extending between the first cartridge housing and the transmission housing for interconnecting the first cartridge housing and the transmission housing.

9. The powered dispensing tool of claim 4, wherein the first cartridge housing includes a rear end plate coupled directly to the transmission housing by the fastener.

10. The powered dispensing tool of claim 1, wherein the first and second plungers are movable within the first cartridge housing in a direction substantially parallel to the longitudinal axis in response to powered translation of the rack in the forward direction, and in response to manual translation of the rack in the forward and reverse directions.

11. The powered dispensing tool of claim 1, further comprising:

first and second rods coupled to the first and second plungers, respectively, and a handle interconnecting the first and second rods.

12. The powered dispensing tool of claim 11, wherein the first plunger is coupled to a first end of the rack.

13. The powered dispensing tool of claim 12, wherein the first plunger includes a recess, and wherein the first end of the rack is positioned within the recess.

14. The powered dispensing tool of claim 12, wherein the handle is coupled to a second end of the rack.

15. The powered dispensing tool of claim 14, wherein powered translation of the rack in the forward direction is directly imparted to the first plunger, and wherein powered translation of the rack in the forward direction is indirectly imparted to the first plunger via the handle and the first rod.

16. The powered dispensing tool of claim 14, wherein powered translation of the rack in the forward direction is indirectly imparted to the second plunger via the handle and the second rod.

17. The powered dispensing tool of claim 11, wherein the housing includes a notch in which at least one of the first and second rods is at least partially received.

18. The powered dispensing tool of claim 17, wherein the notch in the housing is a first notch, and wherein the transmission housing includes a second notch in which at least one of the first and second rods is at least partially received.

19. The powered dispensing tool of claim 18, wherein the first and second notches are substantially aligned.

20. The powered dispensing tool of claim 1, wherein the first cartridge housing includes a front end plate, and a notch positioned in the front end plate through which a common nozzle of the first and second material cartridges extends.

* * * * *